US011597064B2

(12) United States Patent
Glockseisen et al.

(10) Patent No.: US 11,597,064 B2
(45) Date of Patent: Mar. 7, 2023

(54) PRESSING TONGS OR CRIMPING PLIERS

(71) Applicant: WEZAG GmbH Werkzeugfabrik, Stadtallendorf (DE)

(72) Inventors: Thomas Glockseisen, Duesseldorf (DE); Roman Zinser, Neustadt (DE)

(73) Assignee: WEZAG GmbH & Co. KG, Stadtallendorf (DE)

( * ) Notice: Subject to any disclaimer, the term of this patent is extended or adjusted under 35 U.S.C. 154(b) by 738 days.

(21) Appl. No.: 16/540,527

(22) Filed: Aug. 14, 2019

(65) Prior Publication Data

US 2020/0061785 A1 Feb. 27, 2020

(30) Foreign Application Priority Data

Aug. 23, 2018 (EP) ..... 18190465

(51) Int. Cl.
*B25B 27/14* (2006.01)
*H01R 43/042* (2006.01)

(52) U.S. Cl.
CPC ..... *B25B 27/146* (2013.01); *H01R 43/042* (2013.01)

(58) Field of Classification Search
CPC ..... B25B 27/146; B25B 27/00; B25B 7/123; B25B 7/00; B25B 7/14; H01R 43/042; B23P 11/005
USPC ..... 72/402; 29/268
See application file for complete search history.

(56) References Cited

U.S. PATENT DOCUMENTS 3,336,668 A * 8/1967 Groom ..... B25B 7/16 403/111
3,688,553 A 9/1972 Dernier, Sr.
4,794,780 A 1/1989 Battenfeld
5,012,666 A * 5/1991 Chen ..... H01R 43/042 81/382
5,509,291 A * 4/1996 Nilsson ..... H01R 43/042 72/409.14
5,913,933 A 6/1999 Beetz et al.
6,026,671 A 2/2000 Battenfeld
(Continued)

FOREIGN PATENT DOCUMENTS

CN 101913126 A 12/2010
DE 37 08 727 C2 7/1988
(Continued)

OTHER PUBLICATIONS

EP Application No. 18 173 803.0 filed May 23, 2018 (Not Published Yet).
(Continued)

*Primary Examiner* — Lee D Wilson
*Assistant Examiner* — Jacob Adam Montgomery
(74) *Attorney, Agent, or Firm* — The Sladkus Law Group

(57) ABSTRACT

The invention relates to pressing tongs or crimping pliers (1). The pressing tongs or crimping pliers (1) comprise a fixed pliers jaw (4) and a movable pliers jaw (6). A closing motion of the movable pliers jaw (6) can be initiated by pivoting a movable hand lever (9) via a toggle lever drive (11).

According to the invention, a further lever (48), especially in the form of an additional hand lever (49), is provided. The further lever (48) is coupled to the movable pliers jaw (6) in such a way that when the further lever (48) is pivoted, an opening motion of the pliers jaw (6) into an insertion and/or removal position can be initiated.

18 Claims, 14 Drawing Sheets

(56) References Cited

U.S. PATENT DOCUMENTS

| | | | | |
|---|---|---|---|---|
| 6,053,025 | A | 4/2000 | Beetz et al. | |
| 6,286,358 | B1 | 9/2001 | Beetz et al. | |
| 6,289,712 | B1 | 9/2001 | Beetz et al. | |
| 6,474,130 | B2 | 11/2002 | Battenfeld | |
| 7,155,954 | B2 | 1/2007 | Battenfeld | |
| 8,127,589 | B2 | 3/2012 | Battenfeld | |
| 8,516,872 | B2 | 8/2013 | Battenfeld et al. | |
| 9,864,948 | B2 | 1/2018 | Glockseisen | |
| 2009/0178518 | A1* | 7/2009 | Buchanan | B25B 7/123 81/324 |
| 2010/0186558 | A1* | 7/2010 | Hile | B25B 7/123 81/370 |
| 2010/0218648 | A1 | 9/2010 | Chervanak | |
| 2017/0239788 | A1* | 8/2017 | Battenfeld | H01R 43/042 |

FOREIGN PATENT DOCUMENTS

| | | | |
|---|---|---|---|
| DE | 197 09 639 | A1 | 9/1998 |
| DE | 693 1 9 628 | T2 | 11/1998 |
| DE | 198 02 287 | C1 | 12/1998 |
| DE | 197 13 580 | C2 | 12/1999 |
| DE | 198 07 737 | C2 | 6/2000 |
| DE | 198 34 859 | C2 | 1/2001 |
| DE | 199 63 097 | C1 | 4/2001 |
| DE | 199 24 087 | C2 | 6/2002 |
| DE | 199 24 086 | C2 | 8/2002 |
| DE | 197 53 436 | C2 | 10/2002 |
| DE | 103 46 241 | B3 | 8/2004 |
| DE | 10 2007 001 235 | B4 | 6/2010 |
| EP | 0860245 | B1 | 2/1998 |
| EP | 2 305 428 | A1 | 9/2009 |
| EP | 2 995 424 | A1 | 9/2014 |
| EP | 3 208 044 | A1 | 2/2016 |
| JP | 61112862 | A | 7/1986 |

OTHER PUBLICATIONS

EP Application No. 18166729.6, filed Apr. 11, 2018 (Not Published Yet).

Product catalogue "Werkzeuge für die professionelle Anwendung" (publication No. Oct. 2011) of the WEZAG GmbH Werkzeugfabrik company, Nov. 1, 2011.

Publication "Crimptechnik, Herstellung prozesssicherer Verbindungen von elektrischen Leitem und Steckern" of the WEZAG GmbH Werkzeugfabrik company, Die Bibliothek der Technik 342, Verlag Moderne Industrie, ISBN 978-3-68236-027-7, dated Oct. 10, 2011.

* cited by examiner

PRESSING TONGS OR CRIMPING PLIERS

CROSS REFERENCE TO RELATED APPLICATIONS

This application claims priority to co-pending European Patent Application No. EP 18 190 465.7 filed Aug. 23, 2018.

FIELD OF THE INVENTION

The present invention relates to pressing tongs or crimping pliers. By means of pressing tongs or crimping pliers, a workpiece can be pressed or crimped by manually actuating hand levers.

Crimping pliers especially serve for establishing a permanent mechanical connection and electrical contact. This is achieved preferably by crimping a plug to a cable or an electrical conductor of any kind. Depending on a profile of dies employed, different crimping processes can be executed with the crimping pliers and in particular different types of crimping contours can be produced. For example, the crimp can be a closed crimp, in which the conductor is inserted into a closed crimping zone of a plug or into a closed sleeve and is crimped by plastic deformation of the crimping zone or the sleeve. It is also possible that an open crimp is produced, in which the plug comprises an open crimping zone into which the conductor can be inserted from above. To mention only some examples not limiting the invention, with the crimping tool workpieces such as

- terminals according to German standard DIN 4623,
- aluminum connectors according to DIN 46329,
- aluminum press-fit terminals according to DIN 48201,
- crimp terminals according to DIN 46234,
- pin terminals according to DIN 46230 or
- connectors, plugs or terminals for connecting to a cable or conductor as described in the product catalogue "Werkzeuge für die professionelle Anwendung" of WEZAG GmbH Werkzeugfabrik (publication no. 10/11)

can be crimped. The crimp produced, if it is an open crimp, may be a hexagonal crimp, a square-type crimp, a B crimp, a trapezoidal crimp, a modified trapezoidal crimp, an oval crimp, a mandrel crimp or a double mandrel crimp. An open crimp may e.g. be realized as a V crimp or B crimp, a rolled crimp or a double rolled crimp.

In addition to establishing the electric connection between cable or conductor and plug, a mechanical connection may be established by means of a so-called isolation crimp. A closed isolation crimp or an open isolation crimp (especially a V crimp or B crimp, O crimp or OV crimp) may be employed. With regard to further information

- on a design of generic crimping pliers,
- on possible uses of the generic crimping pliers and/or
- on different possible types of crimp connections which can be created with the generic crimping pliers, the document

- "Crimptechnik, Herstellung prozesssicherer Verbindungen von elektrischen Leitern and Steckern" of WEZAG GmbH Werkzeugfabrik (Die Bibliothek der Technik 342, Verlag Moderne Industrie, ISBN 978-3-68236-027-7)

is pointed towards. Generic pliers in different modes of construction are e.g. known from documents DE 37 08 727 C2, corresponding to U.S. Pat. No. 4,794,780 A, DE 197 13 580 C2, corresponding to U.S. Pat. No. 5,913,933 A, DE 197 53 436 C2, DE 198 02 287 C1, corresponding to U.S. Pat. No. 6,053,025 A, DE 198 07 737 C2, corresponding to U.S. Pat. No. 6,026,671 A, EP 3 208 044 A1, corresponding to US 2017/0239788 A1, and EP 2 305 428 A1, corresponding to U.S. Pat. No. 8,516,872 B2.

Generic pressing tongs, on the contrary, preferably serve to establish fluid-tight mechanical connections in fluid technology—e.g. in ductwork systems—for example in order to connect pipes to one another or to fluidic connector plugs. By means of the pressing tongs, the pipes to be connected or a fitting to provide mechanical connection and fluid-tight sealing are plastically deformed. Exemplary embodiments of generic pressing tongs can be seen from documents DE 197 09 639 A1, DE 198 34 859 C2, DE 199 24 086 C2, corresponding to U.S. Pat. No. 6,286,358 B1, DE 199 24 087 C2, corresponding to U.S. Pat. No. 6,289,712 B1, DE 199 63 097 C1, corresponding to U.S. Pat. No. 6,474,130 B2, DE 103 46 241 B3, EP 2 995 424 A1, corresponding to U.S. Pat. No. 9,864,948 B2.

DE 10 2007 001 235 B4, corresponding to U.S. Pat. No. 8,127,589 B2, discloses non-generic pressing tongs in which the pliers jaws are pivotably connected to each other by a pivot joint. A first hand lever is linked to the pivot joint. A second hand lever is linked to a first pliers jaw by means of an angulate end portion. Finally, a third hand lever is arranged between the first hand lever and the second hand lever in an open position of the pliers jaws. The third hand lever is linked to a stabilizer link in an angulate end portion, where the other end portion of the stabilizer link is linked to a second pliers jaw. In the region of their angulate portions, the first hand lever and the third hand lever are coupled to one another via a pressure lever. The pressure lever is pivotably linked to each hand lever, where a pivot bolt for coupling the pressure lever to the third hand lever is fixed to the first hand lever. In order to initiate a closing motion of the pliers jaws, the three hand levers in two consecutive partial closing strokes may use different toggle lever drives optimized for each partial closing stroke with regard to forces. The three hand levers and the different toggle lever drives work as follows: In a first partial closing stroke, the third hand lever is pivoted towards the first hand lever. The joint between the end portion of the third hand lever and the stabilizer link forms a toggle joint of the first toggle lever drive, which is formed with the third hand lever and the stabilizer link. When the end of the first partial closing stroke is reached, the first hand lever and the third hand lever are parallel to one another and the first toggle lever drive as well as the first hand lever and the third hand lever are fixed in position by the enclosing hands of the user or a suitable switching device. In the subsequent second partial closing stroke, the second hand lever is pivoted towards the first and the third hand lever. A second toggle lever drive is in connection with the other pliers jaw. In this second toggle lever drive, a toggle lever is formed by the pressure lever while the other toggle lever is formed by the angulate end portion of the second hand lever and the toggle joint is formed by the pivot joint between the pressure lever and the second hand lever. The three hand levers therefore enable different partial closing strokes of the pliers jaws with different closing motions of a sub-combination of the three hand levers each.

U.S. Pat. No. 3,688,553 relates to pressing tongs for pressing a fitting for a ductwork system. A die that in a closed state comprises a circular cross section is formed with three die parts, which each limit a partial circumference of the circular cross section of the die. Two pivoting jaws supported pivotably on a pliers head formed with housing plates form a first and a second die part. These die parts each form a quarter part of the cross section of the die, which in a closed state is circular. The third die part forming a semicircle of the cross section of the die, which in a closed state is circular, is provided by a push rod. For a first embodiment of the pressing tongs, two hand levers are linked to the push rod via a pivot bolt in their end portions. With a distance to this linking point, end portions of draw shackles are linked to the hand levers, the other end regions of which in turn are linked to the housing plates of the pliers head. By means of pivoting the hand levers towards each other, a motion of the push rod in the closing direction of the die can therefore be induced. The push rod comprises actuation surfaces, which are inclined with respect to a sliding direction of the push rod. Rollers supported on end regions of the crimping jaws roll off these actuation surfaces. The sliding motion of the push rod induced by the closing motion of the hand levers therefore on the one hand leads to a motion of the third die part formed by the push rod in the sliding and closing direction and via the actuation by the actuation surfaces on the other hand leads to the closing motion of the crimping jaws. The position of the actuation surfaces is chosen in such a way that at first the fitting is pressed into an elongated cross section by the crimping jaws and the die part formed by the push rod only comes into effective interaction with the fitting and only crimps the elongated cross section induced previously into the intended circular cross section when the closed position of the crimping jaws is reached. For a second embodiment, the actuation surfaces of the push rod are not employed so that the crimping jaws are not actuated via contact of rollers of the crimping jaws with the actuation surfaces. Accordingly, by means of the pivoting of the hand levers towards each other, only the third die part formed by the push rod is actuated. In this embodiment, a third hand lever is present, which in the end region arranged in the pliers head has an angulate shape. In the region of the angulation, the third hand lever is linked to a pressing jaw via a pivot joint. The free end region of the angulation is pivotably connected to an actuation shackle via a pivot bolt. In another end portion, in turn, the actuation shackle is linked to the other crimping jaw via a pivot bolt. The pivot bolt coupling the third lever to the actuation shackle is guided in an elongated hole of the push rod. When running through a crimping stroke in order to crimp a fitting, the two hand levers as well as the third hand lever are opened so that it is possible to insert the fitting into the jaws of the crimping pliers. Subsequently, the third hand lever is closed while the other two hand levers are open. Closing the third hand lever results in the crimping jaws being closed and the fitting being deformed into an elongated crimped state. The closed position of the third hand lever, once reached, self-locks. Now, the two hand levers can be pivoted. In this way, the push rod is moved and by means of the front face of the push rod the fitting is deformed into the intended circular cross section.

Further prior art is known from DE 693 19 628 T2, corresponding to U.S. Pat. Nos. 5,509,291 A, and 5,012,666 A.

SUMMARY OF THE INVENTION

According to the invention, pressing tongs or crimping pliers for crimping or pressing a workpiece comprise a fixed pliers part with a fixed hand lever and a fixed pliers jaw, a movable hand lever, a movable pliers jaw, a further lever, a drive mechanism, a drive connection and an insertion and/or extraction position. The movable hand lever can undergo a pivoting motion towards the fixed hand lever, the further lever can undergo a pivoting motion and the movable pliers jaw can undergo a closing motion and an opening motion. The movable hand lever is coupled to the movable pliers jaw via the drive mechanism in such a way that the drive mechanism is arranged to convert the pivoting motion of the movable hand lever towards the fixed hand lever into the closing motion of the movable pliers jaw. When the closing motion of the movable pliers jaw is executed, the workpiece can be crimped or pressed. The further lever is coupled to the movable pliers jaw—forming the drive connection—in such a way that the drive connection is arranged to convert the pivoting motion of the further lever into the opening motion of the pliers jaw, where the opening motion of the pliers jaw brings the pressing tongs or crimping pliers into the insertion and/or extraction position.

With the novel pressing tongs or crimping pliers, it is possible to provide manually actuated pressing tongs or crimping pliers which are improved with regard to the force characteristics, ease and convenience of use and/or safety and reliability of use, especially where inserting a workpiece into the pressing tongs or crimping pliers and/or removing a workpiece from the pressing tongs or crimping pliers are concerned.

The invention relates to pressing tongs or crimping pliers of any mode of construction (cp. also the prior art summarized above), as long as they comprise a fixed pliers part with a fixed hand lever and a fixed pliers jaw. The fixed pliers part may have one or more parts. Furthermore, the pressing tongs or crimping pliers according to the invention comprise a movable hand lever. The movable hand lever is coupled to a movable pliers jaw by means of a drive mechanism. The drive mechanism may be realized as any geared connection with a suitable upward or downward transmission of forces and displacements. The movable hand lever is coupled to the movable pliers jaw via the drive mechanism in such a way that when the movable hand lever is pivoted towards the fixed hand lever, a closing motion of the movable pliers jaw can be initiated. With this closing motion of the movable pliers jaw, a workpiece is crimped or pressed between the fixed pliers jaw and the movable pliers jaw, especially where dies are held or formed by the pliers jaws.

Surprisingly, the invention proposes to equip the pressing tongs or crimping pliers with a further lever (in addition to the fixed hand lever and the movable hand lever). The further lever is coupled to the movable pliers jaw via a drive connection. The coupling via the drive connection is realized in such a way that when the further lever is pivoted an opening motion of the pliers jaws into an insertion and/or removal position can be initiated.

Within the framework of the invention it is e.g. possible for the motion of the further lever to be permanently coupled to the motion of the movable hand lever, so that when one of the two levers is actuated the movable hand lever and the further lever are pivoted to the same amount or to different amounts, where a transmission ratio is fixedly set, set by construction parameters or variable. It is also possible, however, for the motion of the further lever to be decoupled from the motion of the movable hand lever over a partial stroke or the entire stroke so that is possible to pivot the further lever while the movable hand lever is not pivoted along with it (and/or the reverse).

The different levers provided may be used for different purposes within the framework of the invention: While due to manual actuation of the movable hand lever the crimping or pressing of a workpiece may be initiated via a closing motion of the pliers jaws, the manual actuation of the further lever may be used in order to initiate an opening motion of the pliers jaws into an insertion and/or removal position, in which insertion and/or removal of a workpiece is enabled or simplified.

The further lever is preferably arranged within the reaching area of a hand which encloses or grasps the fixed hand lever and/or the movable hand lever, or of a finger of this hand, so that the actuation of the movable hand lever in order to initiate the closing motion of the pliers jaws for crimping or pressing a workpiece can be initiated e.g. without any change of the hand position or with minimal hand effort on the one hand and on the other hand by actuating the further lever the opening motion of the pliers jaws into the insertion and/or removal position can be initiated.

The further lever may have any shape (e.g. a straight or angulate shape), have any length and/or may be arranged at any position on the pressing tongs or crimping pliers. For one embodiment of the pressing tongs or crimping pliers, the further lever is an additional hand lever arranged between the fixed hand lever and the movable hand lever. This embodiment uses an interspace that is present between the fixed hand lever and the movable hand lever anyway in order to accommodate the additional hand lever. In this case, the additional hand lever and the movable hand lever are pivoted in the same pivoting plane. It is possible for the end portion of the additional hand lever turned away from the pliers head of the pressing tongs or crimping pliers to be arranged within the pivoting circle of the corresponding end portion of the movable hand lever or without or within the pivoting circle.

The actuation kinematics for the actuation of the additional hand lever and the transmission of the motion of the additional hand lever onto the movable pliers jaw may be realized in any way. For one embodiment, the additional hand lever is coupled to the movable pliers jaw via the drive connection in such a way that when the additional hand lever is pivoted towards the fixed hand lever, an opening motion of the pliers jaws may be initiated. Without intending this to limit the invention, a possible effect of this embodiment is explained by means of the following example: If the palm of a hand of the user rests against the outer surface of the fixed hand lever, the user can reach around the additional hand lever with at least one finger and with the force of the at least one finger pivot the additional hand lever towards the fixed hand lever, in which way the opening motion of the pliers jaws is achieved and the insertion and/or removal position can be initiated and the workpiece can be inserted into or removed from the pliers jaws or the corresponding dies. If the closing motion of the pliers jaws for crimping or pressing the workpiece is to be initiated, the user removes his or her fingers from the additional hand lever and puts them against the movable hand lever from the outside while the palm of the hand may still rest on the fixed hand lever from the outside. The user can then apply the necessary forces onto the movable hand lever with his or her fingers in order to initiate the closing motion of the pliers jaws for crimping or pressing a workpiece.

The drive connection via which the additional hand lever is coupled to the movable pliers jaw may be realized as any geared connection with an upward or downward transmission ratio. For one embodiment of the pressing tongs or crimping pliers, the drive connection is a rigid connection of the additional hand lever to the movable pliers jaw. It is possible e.g. for the additional hand lever to be realized as an integral part with the movable pliers jaw or for the additional hand lever and the movable hand lever to be realized as separate parts which are directly or indirectly and detachably or non-detachably, but in any case with a rigid connection, connected to each other. In this way, a constructively simple but dependable drive connection can be provided.

For a further proposal, the pressing tongs or crimping pliers comprise an opening spring. The opening spring is effective onto the movable pliers jaw and/or the movable hand lever (directly or indirectly) in such a way that the movable pliers jaw and/or the movable hand lever are/is automatically moved from a closed position into an opening direction. This is especially advantageous when the pressing tongs or crimping pliers have reached the closed position, in which the workpiece is completely crimped or pressed. By means of the opening spring, an automatic opening of the movable pliers jaws and/or the movable hand lever can then be initiated if the manual forces applied to the fixed hand lever and the movable hand lever are reduced or removed, which increases ease and convenience of use of the pressing tongs or crimping pliers.

It is also possible that the pressing tongs or crimping pliers comprise a closing spring. The closing spring is effective onto the movable pliers jaw and/or the further lever in such a way that the movable pliers jaw is biased in the closing direction and/or the further lever is automatically moved out of a closed position towards an open position. A closing spring force effected by the closing spring and effective onto the movable pliers jaw in the closing direction can e.g. be used to reduce or remove the biasing of the further lever by the user after initiating the insertion and/or removal position by actuation of the further lever and insertion of the workpiece into the dies, while the closing spring force biases the movable pliers jaw in the closing direction. Therefore, the workpiece is clamped between the two pliers jaws with the closing spring force, in which way it can be fixed between the dies in the position and/or orientation that was previously manually induced. If it is fixed between the pliers jaws in such a way, it may also be possible for the workpiece to be readjusted by the user pushing the workpiece into another orientation and/or position, which then leads to the pliers jaws being moved outwards against the effect of the closing spring or to a sliding motion of the workpiece with respect to the dies biased by the closing spring that is subject to friction.

An opening spring and/or a closing spring may be formed by a single spring or several springs, which then may be arranged in a parallel connection or a series connection. The at least one spring may be made of any suitable material (e.g. metal, plastic, elastomer material, composite material). It may be a pressure spring, a tension spring, a rotating angle spring, a torsion spring or any other spring. The at least one spring may be integrated into the force flow of the pressing tongs or crimping pliers at any position. At least one spring with a linear or a non-linear spring characteristic may be employed.

For one embodiment of the pressing tongs or crimping pliers, the closing spring is linked to the fixed pliers part with one spring base while with the other spring base it is linked to the movable pliers part. Alternatively or cumulatively it is possible for the opening spring to be linked to the fixed pliers part with one spring base while with the other spring base it is linked to the movable hand lever.

There are also embodiments in which the opening spring and the closing spring are realized by a single integral spring element, cp. especially the non-pre-published European patent application with application number EP 18 166 729.6.

The invention includes embodiments in which the drive mechanism for the coupling of the movable hand lever to the movable pliers jaw is permanently effective so that when the movable pliers jaw is moved by the further lever, due to the coupling by the drive mechanism the movable hand lever is also moved. For another embodiment of the pressing tongs or crimping pliers, it is proposed that the drive mechanism, via which the movable hand lever is coupled to the movable pliers jaw, comprises a play. The play is limited by a stop. By means of the stop and the play, the following advantageous effect may be initiated: While the movable hand lever is being pivoted towards the fixed hand lever along with a closing motion of the pliers jaws into the closed position—that is, during crimping or pressing of the workpiece—a drive element of the drive mechanism rests against the stop, in which way the play is not effective and a transmission of the pressing or crimping force is possible without play. If, however, the further lever is pivoted into the insertion and/or removal position with an opening motion of the pliers jaws, the drive element moves away from the stop so that a motion occurs making use of the play. This leads to the result that the movable hand lever (in spite of the opening motion of the pliers jaws) is not moved along during the opening motion in order to initiate the insertion and/or removal position by means of actuation of the further lever, which possibly simplifies operation of the pressing tongs or crimping pliers.

The play may have any suitable value so that the effect explained only occurs for a partial motion or for the entire motion explained. For one proposal of the invention, the play is at least of such an amount that in an open position of the moved hand lever, depending on the position of the further lever and caused by the further lever, the movable pliers jaw can be moved from the closed position into the open position without the movable hand lever leaving its open position. In this way, it can be guaranteed that there is no change in the pivoting angle of the movable hand lever during the entire actuation of the further lever.

For another proposal of the invention, the opening spring in an open position of the movable hand lever does not exert an opening spring force onto the movable pliers jaw, which leads to the result that the closing spring force of the closing spring is not reduced by the effect of the opening spring. On the other hand, the closing spring exerts a closing spring force onto the movable pliers jaw. This closing spring force in a closed position of the further lever has a minimum while in an open position of the further lever it has a maximum. The closing spring may be relaxed in the closed position of the further lever, so that the minimum closing spring force is zero. It is also possible, however, for the closing spring force to be already larger than zero in the closed position of the further lever so that the closing spring is always pretensioned. In this way, the closing spring can e.g. guarantee that when a small workpiece is inserted into the dies formed or held by the pliers jaws the workpiece is secured between the dies with a sufficient closing spring force.

It is possible within the framework of the invention that by holding the workpiece by means of the closing spring force of the closing spring the use of a so-called positioner or locator in order to guarantee the correct position or orientation of the workpiece relative to the dies can be rendered superfluous.

Providing the play and a limiting stop can be realized in any way. For one embodiment of the pressing tongs or crimping pliers, the drive mechanism comprises an elongated hole which provides the play. In this case, the stop is realized by an end portion of the elongated hole. This embodiment is a simple but dependable option for providing the play and the stop.

As explained before, in the pressing tongs or crimping pliers any drive mechanism may be employed. Preferably, the drive mechanism is a toggle lever drive. In this case, it is possible that the play and the stop are provided in the toggle lever drive by the fact that the toggle lever drive comprises a pivot bolt, which may be a pivot bolt of a pivot joint for a toggle lever or a pivot bolt for forming the toggle joint. The pivot bolt in this case may be accommodated in an elongated hole, in which way the necessary play and the stop may be provided.

For another embodiment of the pressing tongs or crimping pliers it is suggested for the pressing tongs or crimping pliers to comprise a forced locking mechanism. Forced locking mechanisms serve for securing a closed position of the pliers jaws once it is reached during crimping or pressing of the workpiece if during the pressing or crimping stroke the actuation force is temporarily reduced by the user or the hand is removed from the pressing tongs or crimping pliers. On the other hand, the forced locking mechanism is designed to enable reopening the pressing tongs or crimping pliers when a closed position has been reached. Within the framework of the invention, the effect and the realization of the forced locking mechanism may be specifically adapted to the requirements present as follows: The forced locking mechanism here does not secure the position of the movable pliers jaw over the complete possible range of motion of the movable pliers jaw. Rather than that, the forced locking mechanism does not lock against a motion of the movable pliers jaw caused by the further lever while the forced locking mechanism locks against a motion of the movable pliers jaw caused by the movable hand lever. In other words, the forced locking mechanism does not take effect if the removal and/or insertion position is intended to be initiated by actuation of the further lever, so that an opening motion is possible while the forced locking mechanism is intended to enable the closing motion for crimping or pressing a workpiece while at the same time a closed position once reached is secured.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if a spring is mentioned, this is to be understood such that there is exactly one spring or there are two springs or more springs. Additional features may be added to these features, or these features may be the only features of the respective product.

The reference signs contained in the claims are not limiting the extent of the matter protected by the claims. Their sole function is to make the claims easier to understand.

DETAILED DESCRIPTION

In the following, the invention is further explained and described with respect to preferred exemplary embodiments illustrated in the drawings.

FIG. 1 shows a three-dimensional, exploded view of crimping pliers.

FIG. 2 shows the crimping pliers according to FIG. 1 in a view from above in a partially disassembled state.

FIGS. 3 to 9 show the crimping pliers according to FIGS. 1 and 2 in different operation positions (FIG. 3: storage position; FIG. 4: insertion position; FIG. 5: holding position; FIG. 6: starting position; FIG. 7: closed position; FIG. 8: open position of the movable hand lever and pliers jaws in the closed position; FIG. 9: removal position).

FIG. 10 shows a three-dimensional exploded view of crimping pliers according to FIGS. 1 to 9 with an additional electronics construction unit.

FIGS. 11 and 12 in a view from above show another embodiment of crimping pliers in different partially disassembled states.

FIG. 13 in a view from above shows another embodiment of crimping pliers in a partially disassembled state.

FIG. 14 in a view from above shows another embodiment of crimping pliers in a partially disassembled state.

DESCRIPTION OF THE DRAWINGS

Within the framework of the present description of the drawings, for construction elements which in different embodiments are the same or similar with respect to their geometries and/or functions, the same reference signs are used. If several construction elements that correspond to each other with respect to their function and/or geometry are present in one embodiment, these sometimes are indicated by the same reference signs, where additionally they are differentiated by a), b), . . . . In this case, the reference signs may be used with or without the additional letter.

As a closed position of a movable hand lever or an additional hand lever, a position is referred to in which the movable hand lever or the additional hand lever is maximally pivoted towards the fixed hand lever. A corresponding pivoting motion is referred to as a closing motion or closing stroke. The other way round, an open position and opening motion refers to that position of the movable hand lever or additional hand lever in which the movable lever or additional hand lever is pivoted (preferably maximally) away from the fixed hand lever or the corresponding motion in order to initiate the open position. With respect to the movable pliers part and the movable pliers jaw, the closed position refers to that position in which the pliers jaws are maximally closed, that is, a workpiece arranged in the dies is completely pressed or crimped. The closing motion refers to the motion towards the closed position. An open position of the movable pliers jaw refers to a position of the pliers jaws that is open when compared to the closed position and the opening motion refers to the motion of the pliers jaws towards the open position. Possible open positions are especially an insertion and/or removal position, in which the pliers jaws are open so far that the pliers jaws formed with the dies are opened so far that a workpiece that has not been pressed or crimped can be inserted into the dies with some play and a pressed or crimped workpiece can be removed from the dies with a larger play, a storage position, in which the opening of the pliers jaws is smaller than in the insertion and/or removal position and which the pressing tongs or crimping pliers take up without any forces being effective and without a workpiece having been inserted into the dies (where the storage position of the pliers jaws may, however, correspond to the closed position of the pliers jaws), and a start position, in which the opening of the jaws is smaller than in the insertion and/or removal position but the opening of the jaws is larger than in the storage position and in which before crimping or pressing the workpiece is begun the dies are pressed against the workpiece due to the closing spring force and fix the workpiece in position.

Figure 1:
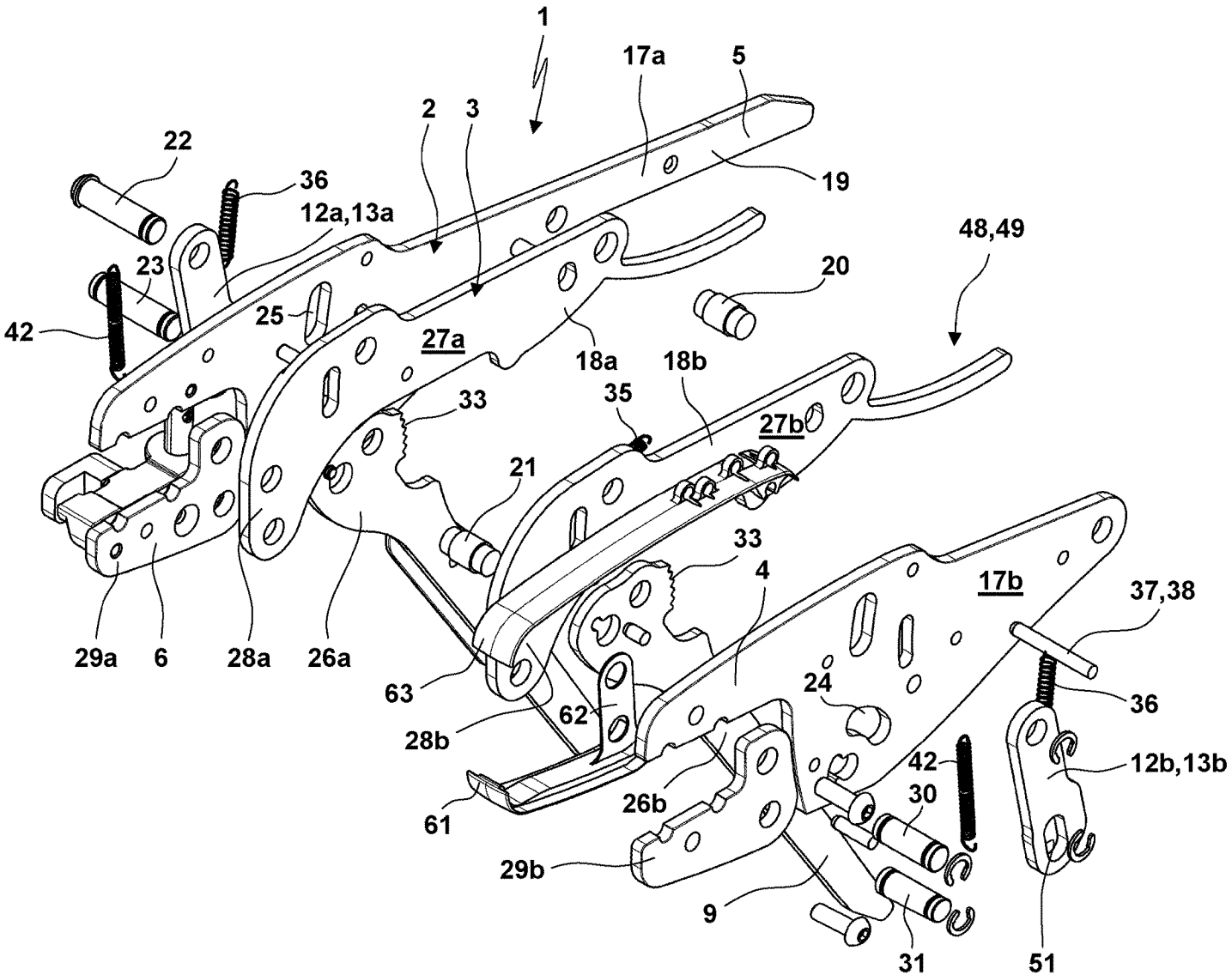
Figure 2:
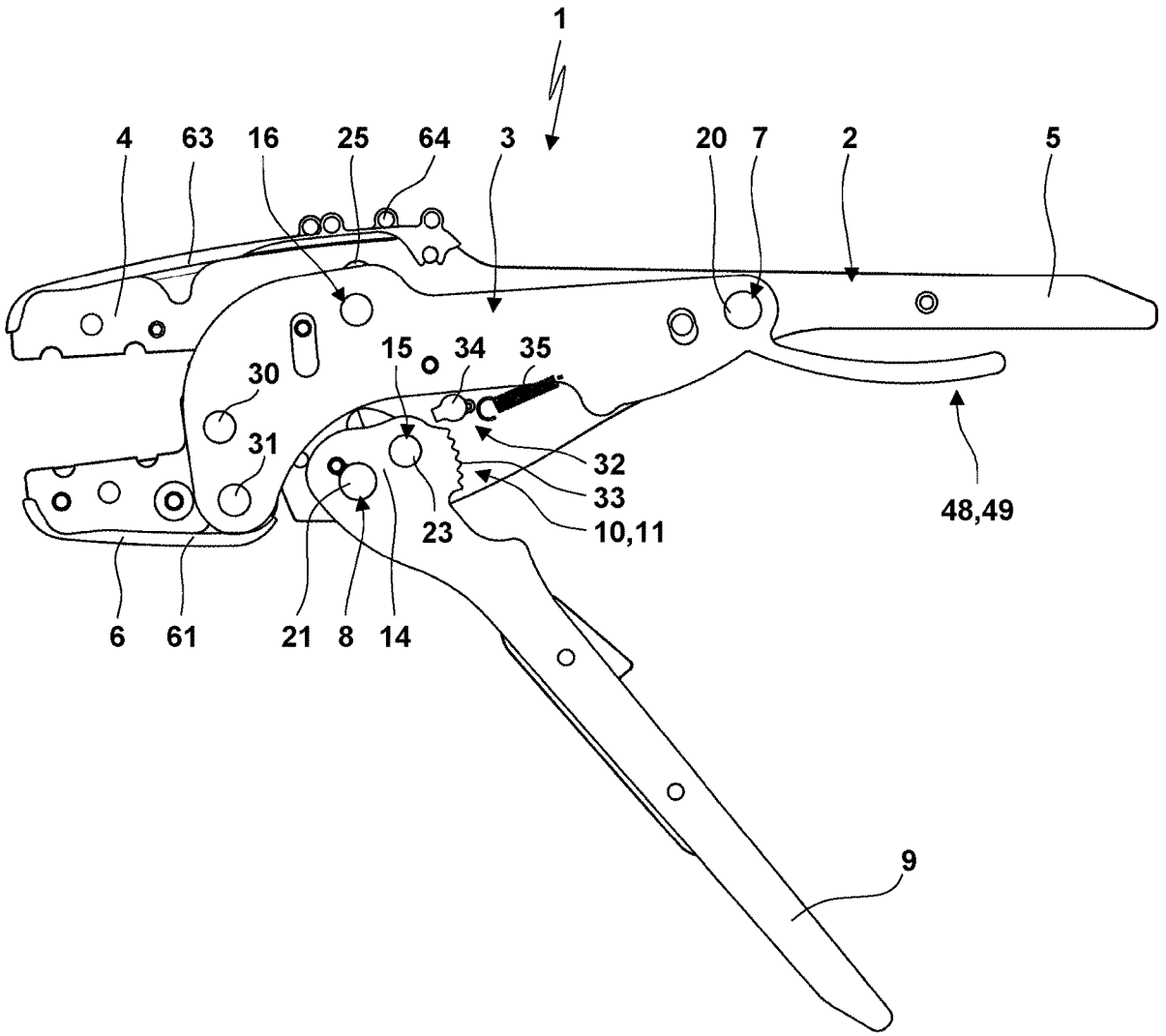

Starting from the starting position, when the movable hand lever is actuated by the user, the pressing or crimping stroke proper is executed which (possibly after some idle stroke) goes from the starting position to the closed position.

For the embodiment of crimping pliers 1 shown in FIGS. 1 to 9, the crimping pliers 1 comprise a fixed pliers part 2 and a movable pliers part 3. The fixed pliers part 2 comprises a fixed pliers jaw 4 and a fixed hand lever 5, which are rigidly connected to one another. The movable pliers part 3 comprises a movable pliers jaw 6.

The fixed pliers part 2 and the movable pliers part 3 are pivotably connected via a pivot bearing 7.

A movable hand lever 9 is pivotably linked to the fixed pliers part 2 via a pivot bearing 8. The movable hand lever 9 is coupled to the movable pliers part 3 via a drive mechanism 10 in such a way that by means of manual pivoting of the movable hand lever 9 relative to the fixed hand lever 5 the fixed pliers part 3 and therefore the movable pliers jaw 6 can be initiated to pivot relative to the fixed pliers jaw 4.

It is possible for the pliers jaws 4, 6 to directly form dies for pressing or crimping a workpiece. For the embodiment shown, the pliers jaws 4, 6, however, support dies via suitable receptacles, where the receptacles and dyes are realized according to patent document U.S. Pat. No. 6,053,025 A, the disclosure of which is made subject of the present patent application.

For the embodiment shown, the drive mechanism 10 is realized as a toggle lever drive 11. As can be seen especially from FIG. 3, the toggle lever drive 11 comprises a toggle lever 13 realized as a pressure lever 12, while the other toggle lever 14 is formed by an angulate end portion of the movable hand lever 9. The two toggle levers 13, 14 are pivotably connected to one another via a toggle joint 15. The toggle lever 14 is formed by the angulate portion of the material of the movable hand lever 9 between the pivot bearing 8 and the toggle joint 15. That end portion of the toggle lever 13 turned away from the toggle joint 15 is linked to the movable pliers part 3 via a pivot bearing 16.

Figure 3:
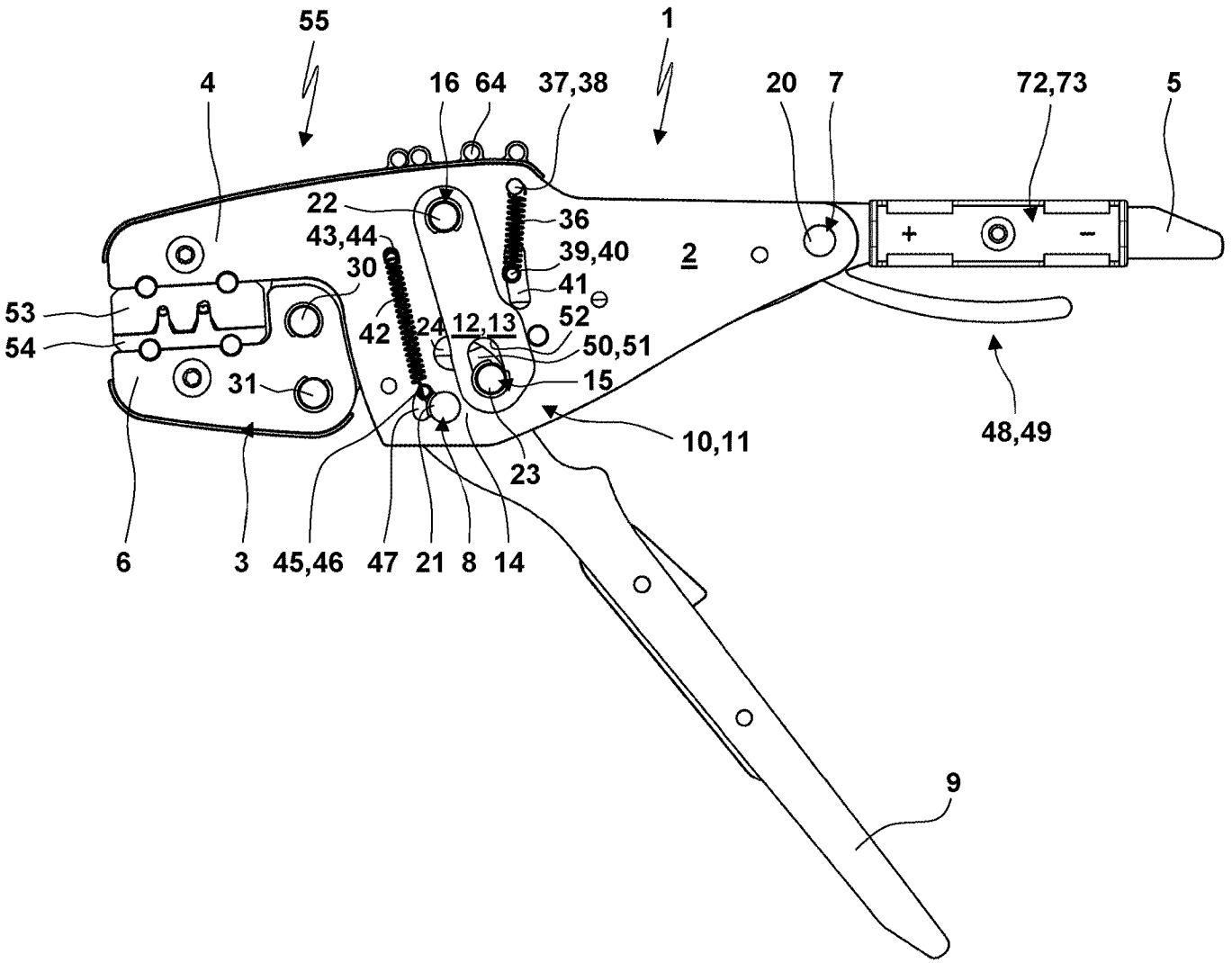

As can especially be seen from FIG. 3, the toggle levers 13, 14 in the storage position 55 form a toggle angle in a range of 90° to 120°. By moving the movable hand lever 3 from its open position into its closed position, the toggle angle can be enlarged, where the toggle lever in the closed position lies e.g. between 170° and 180° so that along with the closing motion the toggle angle approaches the extended position, including the larger force effected by the toggle lever drive 11 connected with that.

In the following, optional design possibilities of the crimping pliers 1 are described which may be employed alternatively or cumulatively:

For the embodiment according to FIGS. 1 to 9, the pliers parts 2, 3 are each realized in a plate-like way—in this embodiment with two plates each, that is, two fixed pliers part plates 17*a*, 17*b* and movable pliers part plates 18*a*, 18*b*. The movable pliers part plates 18*a*, 18*b* are arranged directly neighboring each other and arranged between the two fixed pliers part plates 17*a*, 17*b*. While the movable pliers part plates 18*a*, 18*b* have the same geometry (especially the same outer geometry and the same bore geometry), the fixed pliers part plates 17*a*, 17*b* for the embodiment shown differ in that the pliers part plate 17*a* forms a fixed hand lever part 19, while the fixed pliers part plate 17*b* does not have a corresponding fixed hand lever part.

For the embodiment shown in FIGS. 1 to 9, the pivot bearings 7, 8, 16 and the toggle joint 15 are each realized with a pivot bolt 20, 21, 22, 23, where each pivot bolt 20, 21, 22, 23 is held in a suitable bore on the construction elements connected via the pivot bearing 7, 8, 16 or the toggle joint 15 while enabling the pivoting degree of freedom.

For the embodiment shown in FIGS. 1 to 9, the toggle lever 13 realized by the pressure lever 12 lies outside the fixed pliers part plates 17, while the toggle lever 14 is arranged within the fixed pliers part plates 17*a*, 17*b*. For this reason, the pivot bolt 23 of the toggle joint 15 is guided through the fixed pliers part plates 17*a*, 17*b*. In order not to impede the motion of the pivot bolt 23 during actuation of the toggle lever drive 11, the fixed pliers part plates 17*a*, 17*b* comprise elongated holes 24*a*, 24*b* curved corresponding to the necessary motion of the pivot bolt 23. Correspondingly, the fixed pliers part plates 17 comprise elongated holes 25*a*, 25*b* in order not to impede the motion of the pivot bolt 22 while the toggle lever drive 11 is actuated and in order to enable motion of the movable For the embodiment shown in FIGS. 1 to 9, two movable hand lever plates 26*a*, 26*b* are present which are arranged directly neighboring each other. The movable hand lever plates 26 extend in the same planes as the movable pliers part plates 18. The movable pliers part plates 18 and the movable hand lever plates 26 are each connected rigidly to one another. The same is true for the fixed pliers part plates 17.

For the embodiment shown in FIGS. 1 to 9, two toggle levers 13*a*, 13*b* are present in the shape of two pressure levers 12 which are coupled to one another via the pivot bolts 22, 23 and are arranged on different sides outwardly of the fixed pliers part plates 17.

For the embodiment shown in FIGS. 1 to 9, the movable pliers part plates 18*a*, 18*b* are realized having two parts, which in the following is explained in an exemplary way for a movable pliers part plate 18*a*: The movable pliers part plate 18*a* comprises a supporting plate 27 which comprises the bore for the pivot bolt 21 of the pivot bearing 8. In the end portion turned towards the pliers head, the support plate 27 comprises a mounting portion 28 for a pliers jaw plate 29. For the embodiment shown, the pliers jaw plate 29 is mounted to the supporting plate 27 in the mounting area 28 via two mounting bolts 30, 31 arranged with a distance from one another, which are accommodated in corresponding bores of the supporting plate 27 and the pliers jaw plate 29. The longitudinal axes of the mounting bolts 30, 31 in their mounted state are oriented approximately tangentially to the pivot axis of the pivot bearing 8. The supporting plate 27 and the pliers jaw plate 29 are each roughly L-shaped, where the two short arms of the "L"s overlap in order to form the mounting portion 28 and the long arms of the "L"s are arranged parallel to each other. The pliers jaw plates 29 are attached to the support plates 27 from the outside so that the pliers jaw plates 29 extend in the same plane as the fixed pliers part plates 17*a*, 17*b*.

For the embodiment according to FIGS. 1 to 9, a forced locking mechanism 32 is effective onto the toggle lever drive 11. By means of the forced locking mechanism 32, a position of the movable pliers jaw once reached during the pressing or crimping stroke is intended to be secured against opening, which is achieved in individual steps of the forced locking mechanism 32. When the closed position of the movable pliers jaw 6 has been reached, the forced locking mechanism 32 is no longer effective for securing so that the movable pliers jaw 6 can be opened again. For the embodiment shown, the movable hand lever 9, which here is the movable hand lever plates 26*a*, 26*b*, comprises a locking gear tooth system 33. A locking element 34 engages with the locking gear tooth system 33, being pivotably supported on the fixed pliers part 2 and biased into a locking direction by a spring 35 of the forced locking mechanism 32. The geometry of the locking gear tooth system 33 and the locking element 34 and the effect of the spring 35 are coordinated in such a way that the locking element 34 for a closing motion of the movable hand lever 9 can be moved along the locking gear tooth system 23 in the way of a ratchet, while for an opening motion of the movable hand lever 9 it engages lockingly with the locking gear tooth system 33. When the closed position of the movable hand lever 9 has been reached, the locking element 34 turns over so that another engagement surface of the locking element 34 comes to interact with the locking gear tooth system 33, which enables the opening motion of the hand lever 9.

For the embodiment according to FIGS. 1 to 9, the movable pliers part 3 is biased in the closing direction via a closing spring 36. The closing spring 36 is supported on the fixed pliers part 2 with a spring base 37, which here is achieved via a bolt 38 supported by the fixed pliers part 2. The other spring base 39 is supported on the movable pliers part 3, which here is achieved via a bolt 40 supported by the movable pliers part 3.

For the embodiment according to FIGS. 1 to 9, two closing springs 36 effective onto the movable pliers part 3 in parallel are provided. The two closing springs 36 are arranged outwardly of the two fixed pliers part plates 17. The bolt 40 therefore extends through the in such a way that they do not hinder the motion of the bolt 40 along with the pivoting of the movable pliers part 3.

For the embodiment shown in FIGS. 1 to 9, an opening spring 42 is effective onto the movable hand lever 9. With a spring base 43, the opening spring 42 is supported on the fixed pliers part 2, which here is achieved by means of a bolt 44. The other spring base 45 is supported on the movable hand lever 9, which here is achieved by means of a bolt 46. The other spring base 45 is supported on the movable hand lever 9 eccentrically to the pivot axis of the pivot bearing 8 in such a way that the opening spring 42 biases the movable hand lever 9 in the opening direction.

For the embodiment shown in FIGS. 1 to 9, two opening springs 42 are present which are effective in parallel onto the movable hand lever 9 and are arranged outside the fixed pliers part plates 17. For this reason, the bolt 46 is guided through elongated holes 47*a*, 47*b* of the fixed pliers part plates 17*a*, 17*b*, which are arranged and formed in such a way that they do not hinder the pivoting of the movable hand lever 9. When the open position of the movable hand lever 9 has been reached, the bolt 46 can come to rest at an end portion of the elongated hole 47, in which way the open position of the movable hand lever 9 is set and it is impossible to open the movable hand lever 9 further.

Figure 6:
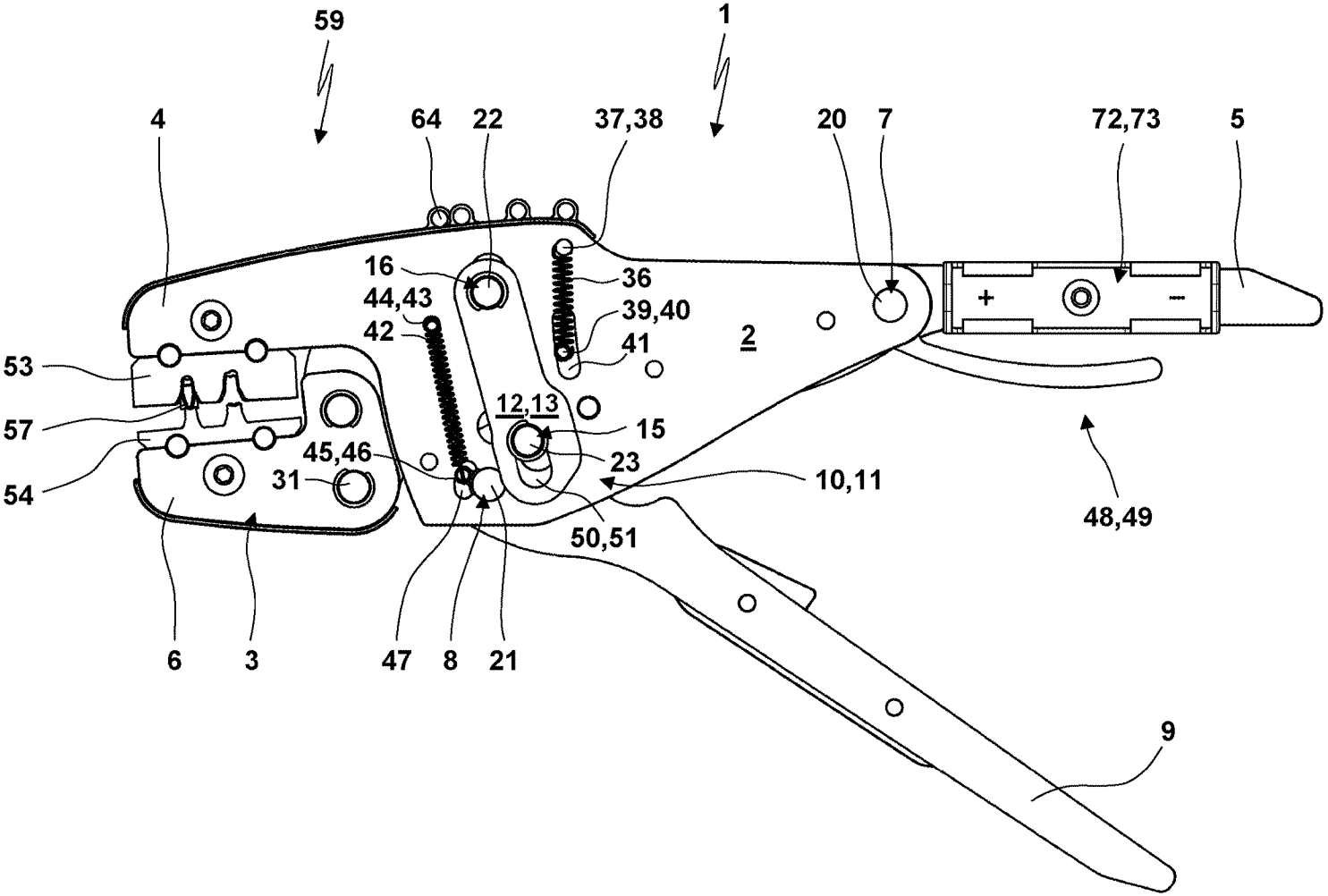
Figure 7:
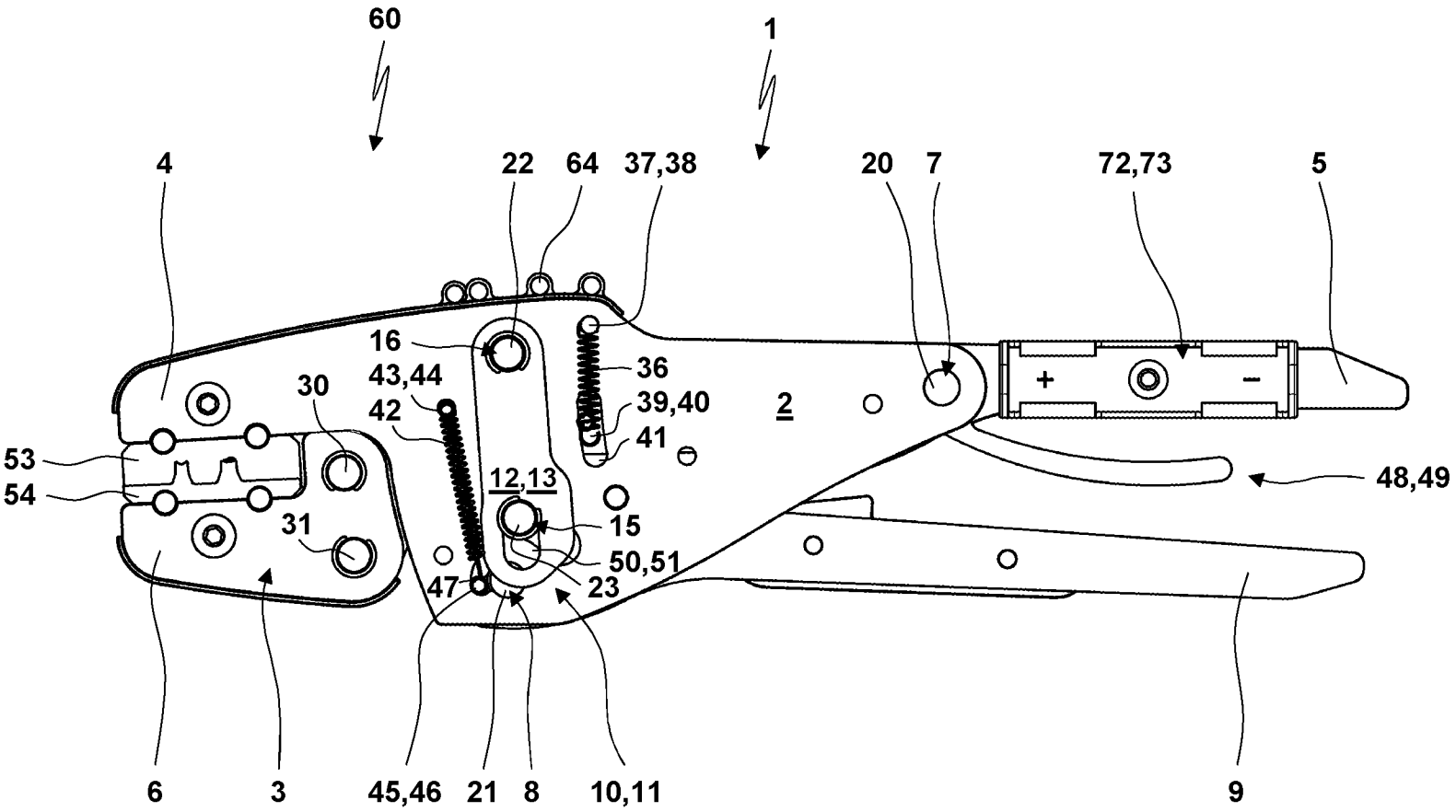
Figure 8:
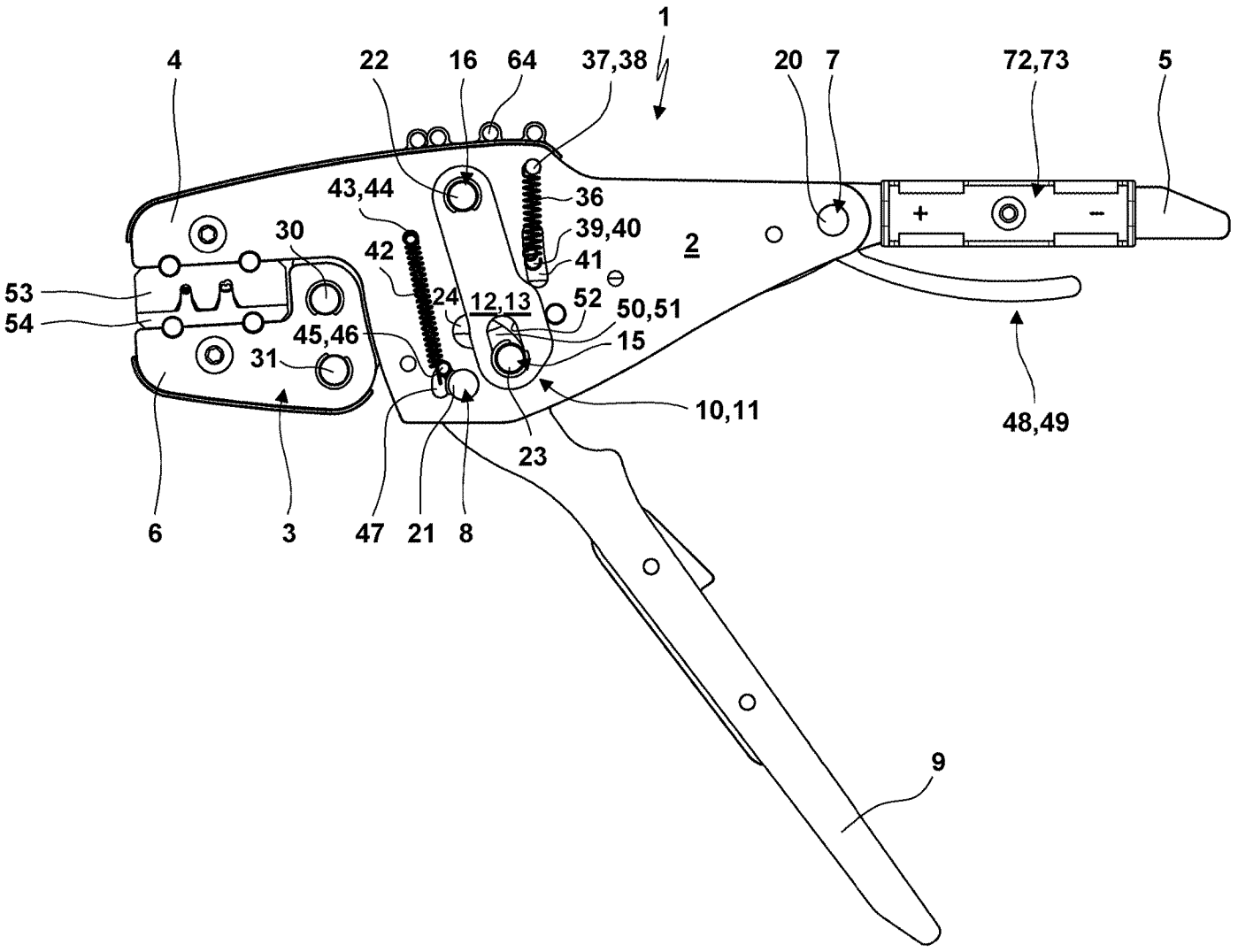

For the embodiment shown in FIGS. 1 to 9, the movable pliers part 3 comprises a further lever 48, which here is realized as an additional hand lever 49. The additional hand lever 49 is realized as a rod-like, e.g. slightly angulate, extension of the movable pliers part plates 18. The additional hand lever 49 is arranged between the fixed hand lever 5 and the movable hand lever 9, where its pivoting range is smaller by e.g. at least a factor of 2, at least a factor of 3, at least a factor of 4, at least a factor of 5 or even at least a factor of 8 than the pivoting range of the movable hand lever 9. In the closed position of the movable hand lever 9 (cp. FIG. 7), the additional hand lever 49 is arranged approximately centrally between the movable hand lever 9 and the fixed hand lever 5. For the embodiment shown, the additional hand lever 49 is shorter than the movable hand lever 9 or the pivoting circle segment of the end portion of the additional hand lever 49 lies within the pivoting circle segment of the movable hand lever 9, without this necessarily having to be the case. The additional hand lever 49 is realized and arranged in such a way that it can be reached around and actuated by a hand which is applied to the fixed hand lever 5 from the outside with the fingers of this hand, at least with a first finger. It is understood that depending on the length of the additional hand lever 49 the number of fingers which can be used for actuation of the additional hand lever 49 can vary.

If the drive mechanism 10, which here is the toggle lever drive 11, is realized without play, each position of the movable hand lever 9 correlates bijectively with a corresponding position of the additional hand lever 49 and the movable pliers part 3 with the movable pliers jaw 6. In order to resolve this bijective correspondence, in the drive mechanism 10, which here is the toggle lever drive 11, play 50 is provided. For the embodiment shown, the play 50 is provided by the toggle levers 13, 14 being coupled with one another not only in the region of the toggle joint 15 via a pivoting degree of freedom, but by the toggle levers 13, 14 also comprising a shifting degree of freedom in the region of the toggle joint 15. In order to achieve this, the toggle levers 13, represented here by the pressure lever 12, in the region of the toggle lever 14 comprise an elongated hole 51 in which the pivoting bolt 23 is slidably guided. The length of the elongated hole 51 defines the play 50. An end drive 11. During the pressing stroke or crimping stroke, the pivoting bolt 23 rests against the stop 52 in order to transmit the pressing force or crimping force.

The function of the crimping pliers 1 according to the embodiment shown in FIGS. 1 to 9 shall now be explained using the different operating positions of the crimping pliers 1 shown in FIGS. 3 to 9:

FIG. 3 shows the crimping pliers 1 without actuation forces applied by the user and without a workpiece inserted into the dies 53, 54. Due to the effect of the closing spring 36, the movable pliers part with the movable pliers jaw 6 or the dies 53, 54 are in the closed position, so that the pliers jaws are opened. This closed position correlates with an open position of the additional hand lever 49. The closing spring 36 is in its state of minimal closing spring force. In the closed position, the closing spring force may be zero or it may already be larger than zero. If the drive mechanism 10 did not have the play 50, the closed position of the pliers jaws 4, 6 would correlate with the closed position of the movable hand lever 9. Since, however, the play 50 is provided—which here is achieved by the elongated hole 51 of the pressure lever 12—the opening spring 42 can move the movable hand lever 9 into the open position. In the open position according to FIG. 3, the opening spring 42 comprises a minimal opening spring force effective in the opening direction. The operating position according to FIG. 3 may also be referred to as the storage position 55.

Figure 4:
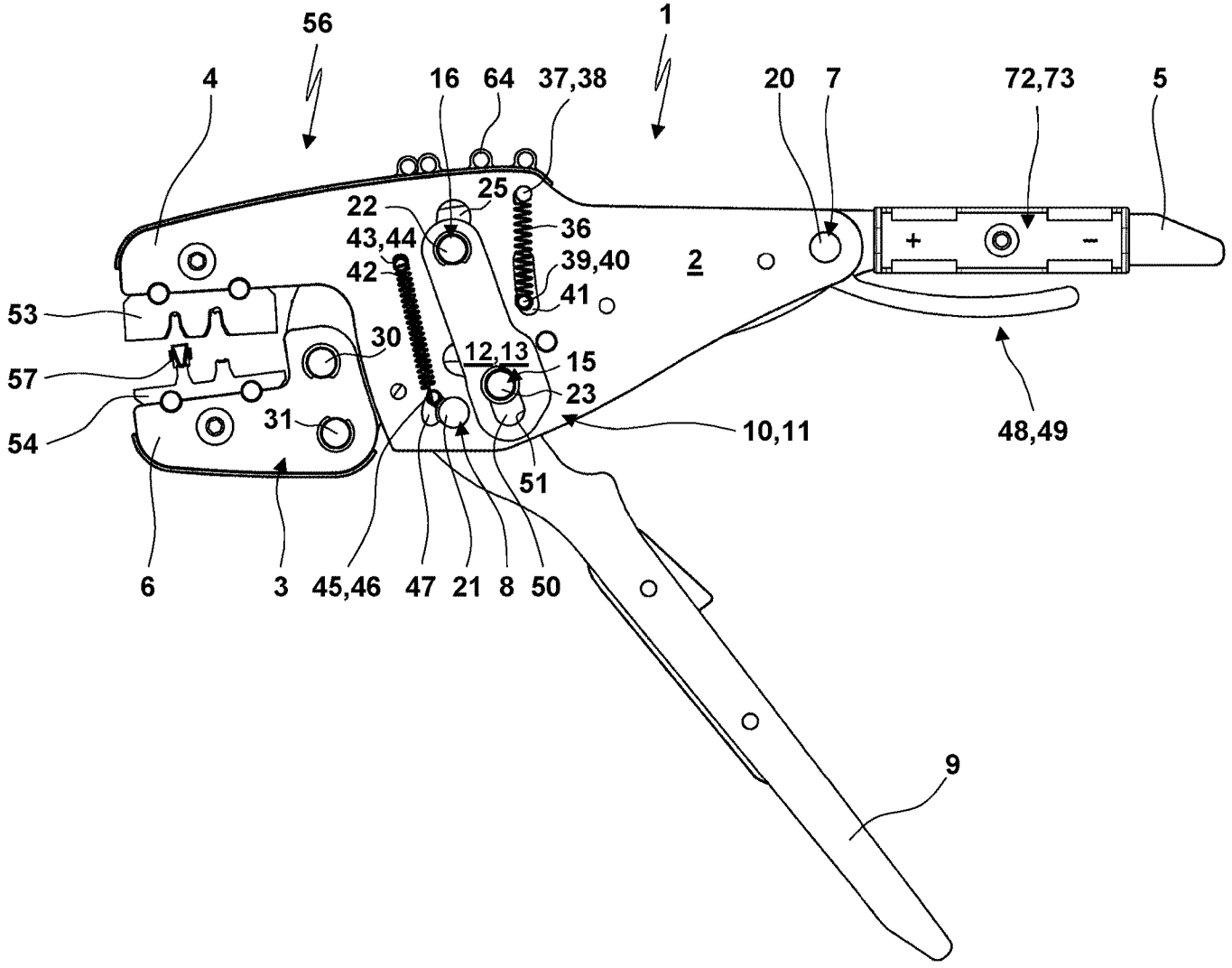
Figure 5:
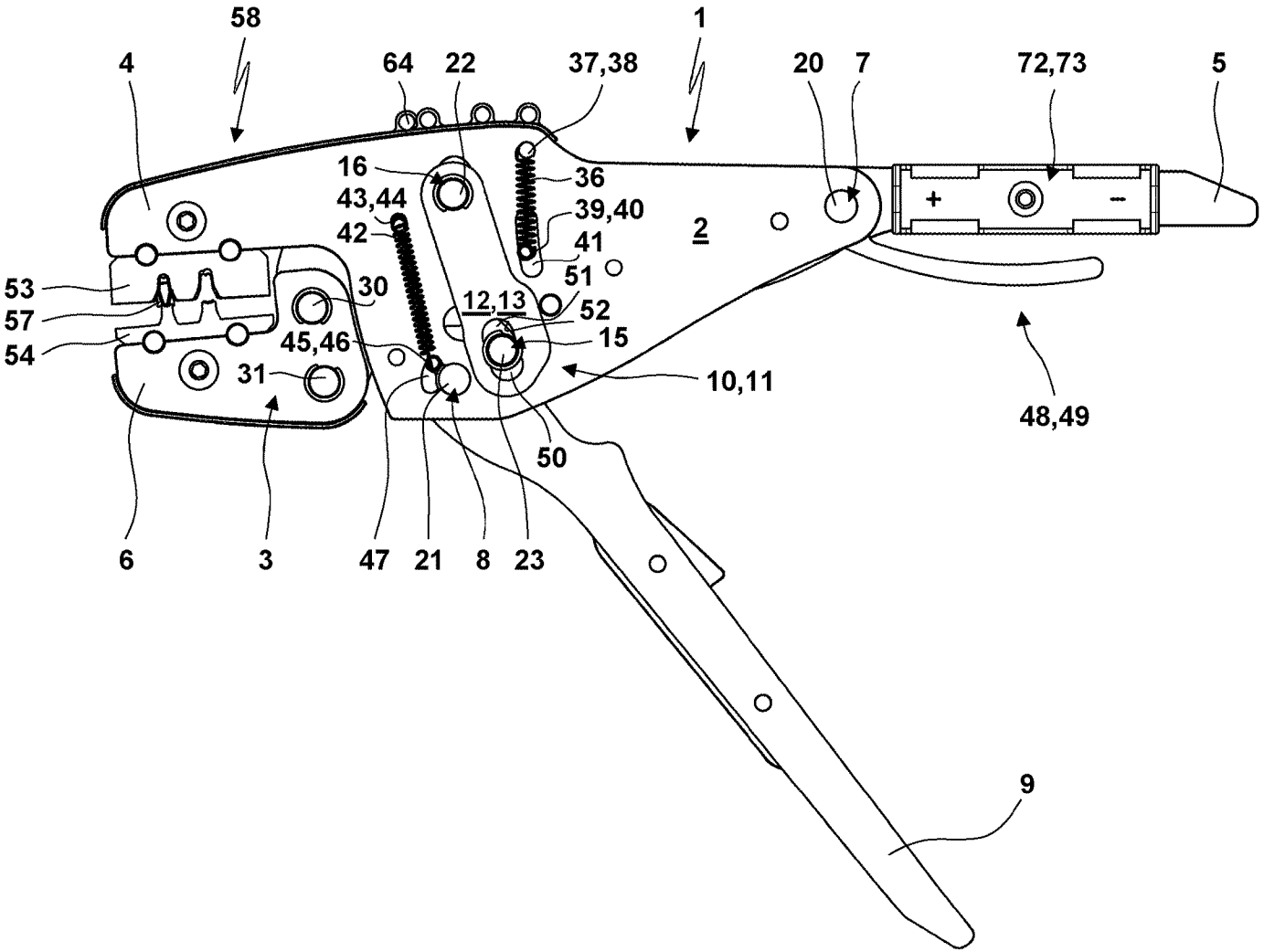

From the storage position 55 according to FIG. 3, an insertion and/or removal position 56 according to FIG. 4 may be initiated. In order to achieve this, the additional hand lever 49 is manually pivoted out of its open position according to FIG. 3 into its closed position according to FIG. 4. This goes along with a corresponding pivoting of the movable pliers part 3, due to which the movable pliers part 3 and the movable pliers jaw 6 take up the open position, that is, the insertion and/or removal position 56. Due to the play 50, the movable hand lever 9 may remain in its open position. While the additional hand lever 49 is being pivoted, the pivoting bolt 23 glides along the elongated hole 51. When the additional hand lever 49 is pivoted, the closing spring force of the closing spring 36 is increased. Since the movable hand lever 9 is not pivoted, the opening spring force of the opening spring 42 does not change. As FIG. 4 indicates, in an insertion and/or removal position 56 initiated in this way, a workpiece 57 can be inserted into the pliers jaws and between the dies 53, 54.

If the hand forces applied manually to the additional hand lever 49 are removed, due to the effect of the closing spring 36 the additional hand lever 49 is automatically moved in the opening direction, which goes along with the closing motion of the movable pliers part 3. This closing motion occurs until a holding position 58 according to FIG. 5 has been reached. In the holding position 58, the closing spring force effected onto the movable pliers part 3 by the closing spring 36 is supported by the workpiece being clamped between the pliers jaws 4, 6 or between the dies 53, 54. This clamping due to the closing spring force leads to the position and/or orientation of the workpiece 57 with respect to the dies 53, 54 being secured. For the transfer from the insertion and/or removal position 56 according to FIG. 4 into the holding position 58 according to FIG. 5, the closing spring force of the closing spring 36 has decreased, where due to the design of the closing spring 36 the closing spring force of the spring 36 is still large enough to guarantee maintaining the position and/or orientation of the workpiece 57 even when a smaller workpiece 57 is used. The opening spring force of the opening spring 42 remains unchanged. During the motion from the insertion and/or removal position 56 according to FIG. 4 into the holding position 58 according to FIG. 5, the pivoting bolt 23 for a partial path has moved along the elongated hole 51 while the pivoting bolt 23 is still arranged with a distance from the stop 52 of the elongated hole 51. The remaining distance of the pivoting bolt 23 from the stop 52 depends on the size of the workpiece 57 in an unpressed or uncrimped state.

The user now can apply actuation forces onto the movable hand lever 9. From the holding position according to FIG. 5, actuation of the movable hand lever 9 at first leads to an idle stroke, in which the motion of the hand lever 9 is not connected to a motion of the movable pliers part 3. Rather than that, in the idle stroke the distance of the pivot bolt 23 from the stop 52 is overcome so that at the end of the idle stroke the pivot bolt 23 comes to rest against the stop 52. In this way, a starting position 59 is reached which is shown in FIG. 6. During the idle stroke, the closing spring force of the closing spring 36 does not change while the opening spring force of the opening spring 42 increases so that during the idle stroke the opening spring 42 has to be deflected by means of the manual actuation force.

Starting from the starting position 59 according to FIG. 6, the pressing stroke or crimping stroke proper may then be executed, at the end of which the closed position 60 according to FIG. 7 is reached. During the pressing stroke or crimping stroke, the play 50 is removed. In the toggle lever drive 11, the pivoting bolt 23 during the pressing stroke or crimping stroke does no longer comprise the translational degree of freedom provided by the elongated hole 51. Rather than that, the pivot bolt 23 rests against the stop 52 in order to transmit forces in the toggle lever drive 11, where a pivoting motion in the region of the stop 52 and the toggle joint 15 provided by it is still possible. During the pressing stroke or crimping stroke, due to the pivoting of the movable hand lever 9 there is further biasing of the opening spring 42. At the same time, while the movable pliers part 3 is pivoted more, the biasing of the closing spring 36 is reduced. When the closed position 7 is reached, the workpiece 57 is completely pressed or crimped between the dies 53, 54.

If the hand forces applied by the user are removed, due to the effect of the closing spring 36 the closed position of the pliers jaws 4, 6 and the open position of the additional hand lever 49 are kept up, in which way the closing spring force produced by the closing spring 36 makes sure that the crimped workpiece 57 is clamped between the pliers jaws 4, 6—which is realized here by clamping between the dies 53, 54—and cannot drop out of the dies 53, 54. The effect of the opening spring 42 leads to a pivoting of the hand lever 9 from the closed position according to FIG. 7 into the open position according to FIG. 8. During this motion, the play 50 of the drive mechanism 10 is used. For the embodiment shown, this means that the pivot bolt 23 moves away from the stop 52.

Figure 9:
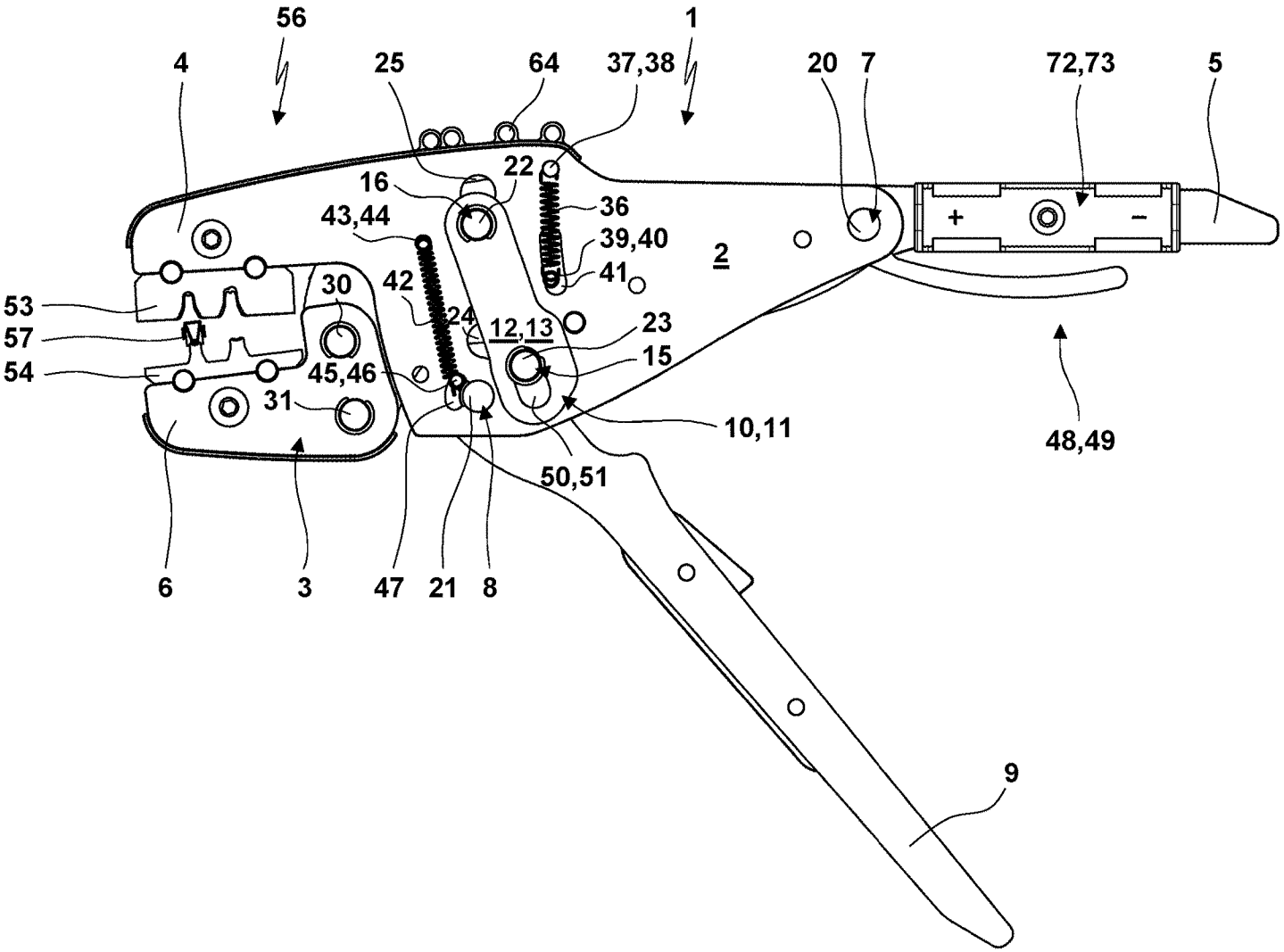

If then the pressed or crimped workpiece 57 is to be removed from the crimping pliers 1, by actuation of the additional hand lever 49 a transfer of the movable pliers part 3 and the movable pliers jaw 6 into the insertion and/or removal position 56 can be initiated (cp. FIG. 9).

If in the crimping pliers 1 a forced locking mechanism 32 is present, it creates a locking effect only during the idle stroke and/or the pressing or crimping stroke, so that the other motions described before are not hindered by the forced locking mechanism 32.

It is possible for an interspace formed between the plates of the crimping pliers 1, which here are the fixed pliers part plates 17 and/or movable pliers part plates 18, to be closed or sealed towards the outside by a cover 61, e.g. made of plastic. For the embodiment shown here, the cover 61 in a rough approximation is T-shaped with a bridge 62 formed by a vertical arm. In the region of the bridge 62, the cover 61 is mounted with the movable pliers part 3, which here is achieved by means of the fixing mounting bolts 30, 31. A corresponding cover 63 extends in the region of the outer front faces of the fixed pliers jaw plates 17. For the embodiment shown, the cover 63 comprises outer mounting eyelets 64, the function of which will be explained in the following.

Figure 10:
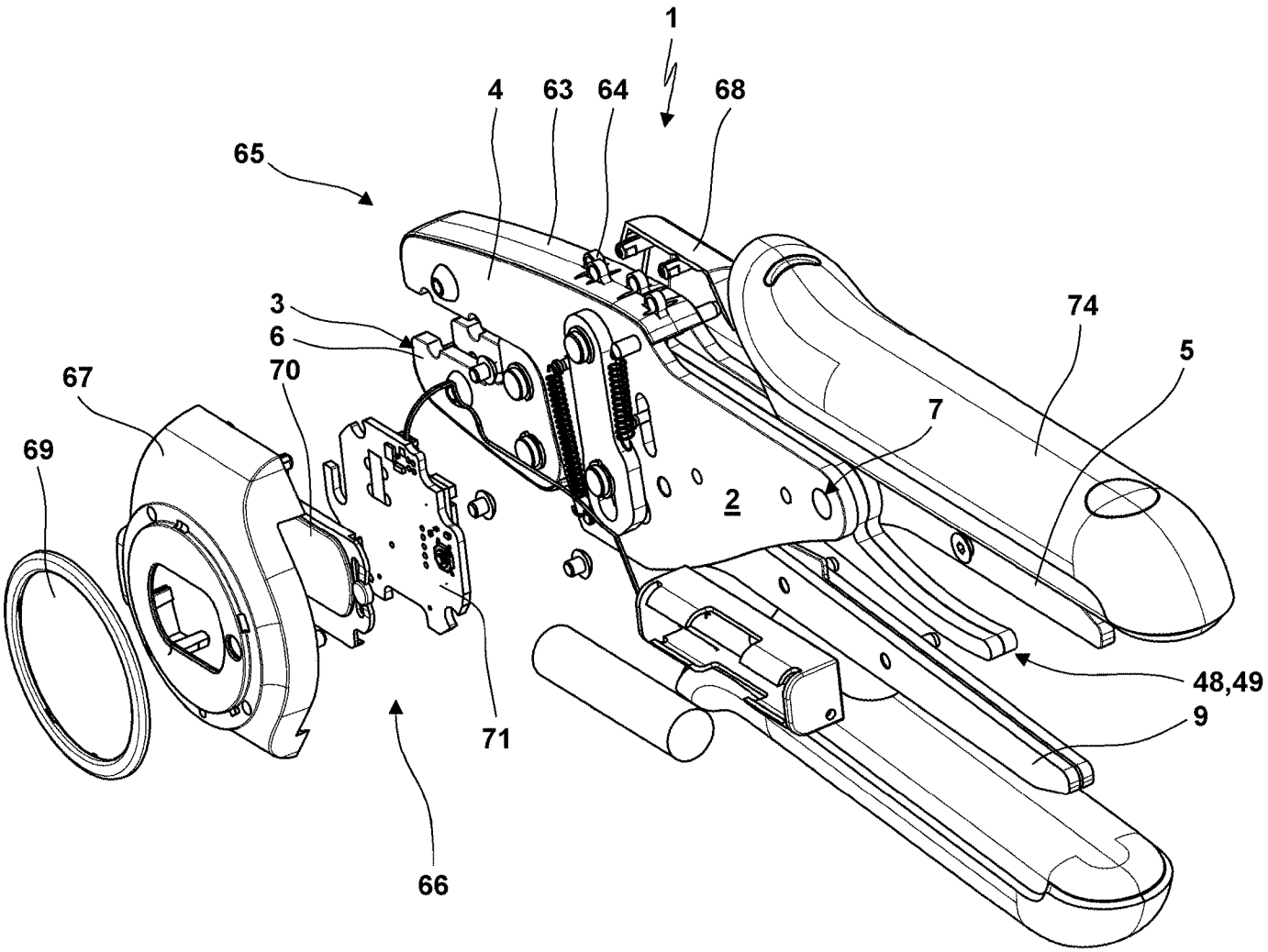

For the embodiment shown in FIGS. 1 to 9, the crimping pliers 1 only comprise a mechanical pliers part 65. For a modified embodiment, the crimping pliers 1 according to FIG. 10 in addition to the mechanical pliers part 65 comprise an electronics construction unit 66. The design of the electronics construction unit 66, its functions, its coupling to the mechanical pliers part 65 and/or its energy supply and its wireless or wire-bound communication may be according to the non-pre-published European patent application having official file number EP 18 173 803.0, which is made subject of the present patent application with regard to the aspects mentioned.

The electronics construction unit 66 comprises a housing which is formed with two half-shell like housing parts 67, 68, where in one housing part 67, 68 a transparent cover pane 69 to form a viewing window for a display 70 may be arranged. In an interspace arranged between the housing, which here is embodied by a housing part 67, and the mechanical pliers part 65, a circuit board 71 is arranged. The housing parts 67, 68 are latched, locked or pressed onto one another and the mounting eyelets 64 via suitable connecting pins and receptacles.

For an electric power supply of the electronics construction unit 66, the electronics construction unit 66 may comprise a holder 72 with a battery or a rechargeable accumulator 73. For the embodiment shown, the holder 72 is held on the fixed pliers part 2, here in the region of the hand lever part 19—which has already been shown in FIGS. 1 to 9 although it is not necessary for the purely mechanical embodiment of the crimping pliers 1. It is possible for a handgrip 74 to have been pushed onto the fixed hand lever part 19 in the interior of which the holder 72 with the battery 73 is accommodated. The handgrip 74 can be fixed to the fixed pliers part 2, which here is the fixed hand lever part 19, which also may be achieved by a latching and/or locking connection, e.g. a releasable connection, in that in order to unlatch the handgrip 74 a press button has to be actuated, which may be arranged e.g. on the inner side turned towards the other hand lever 9. Removal of the handgrip 74 may be used in order to replace a battery or an accumulator 73.

Figure 11:
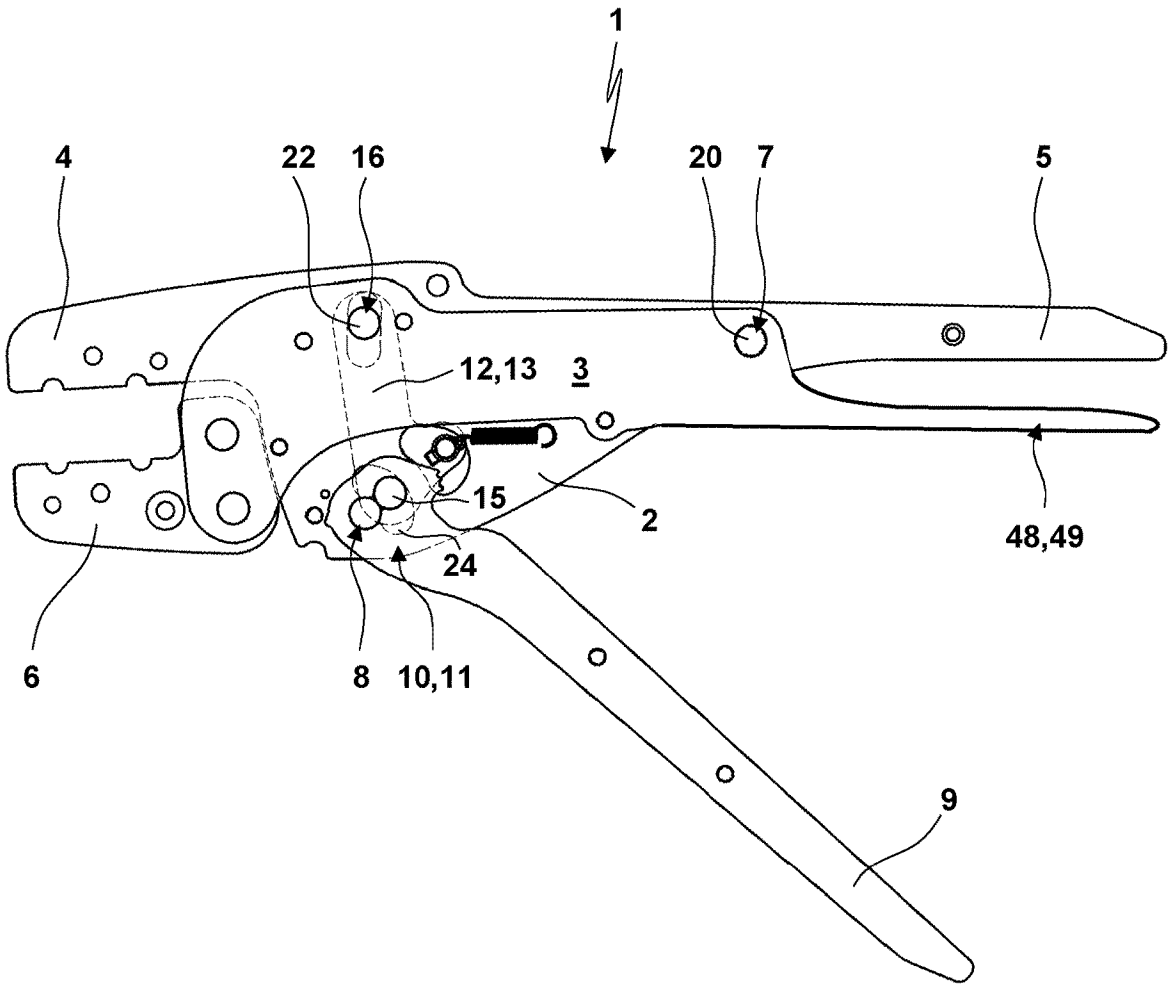
Figure 12:
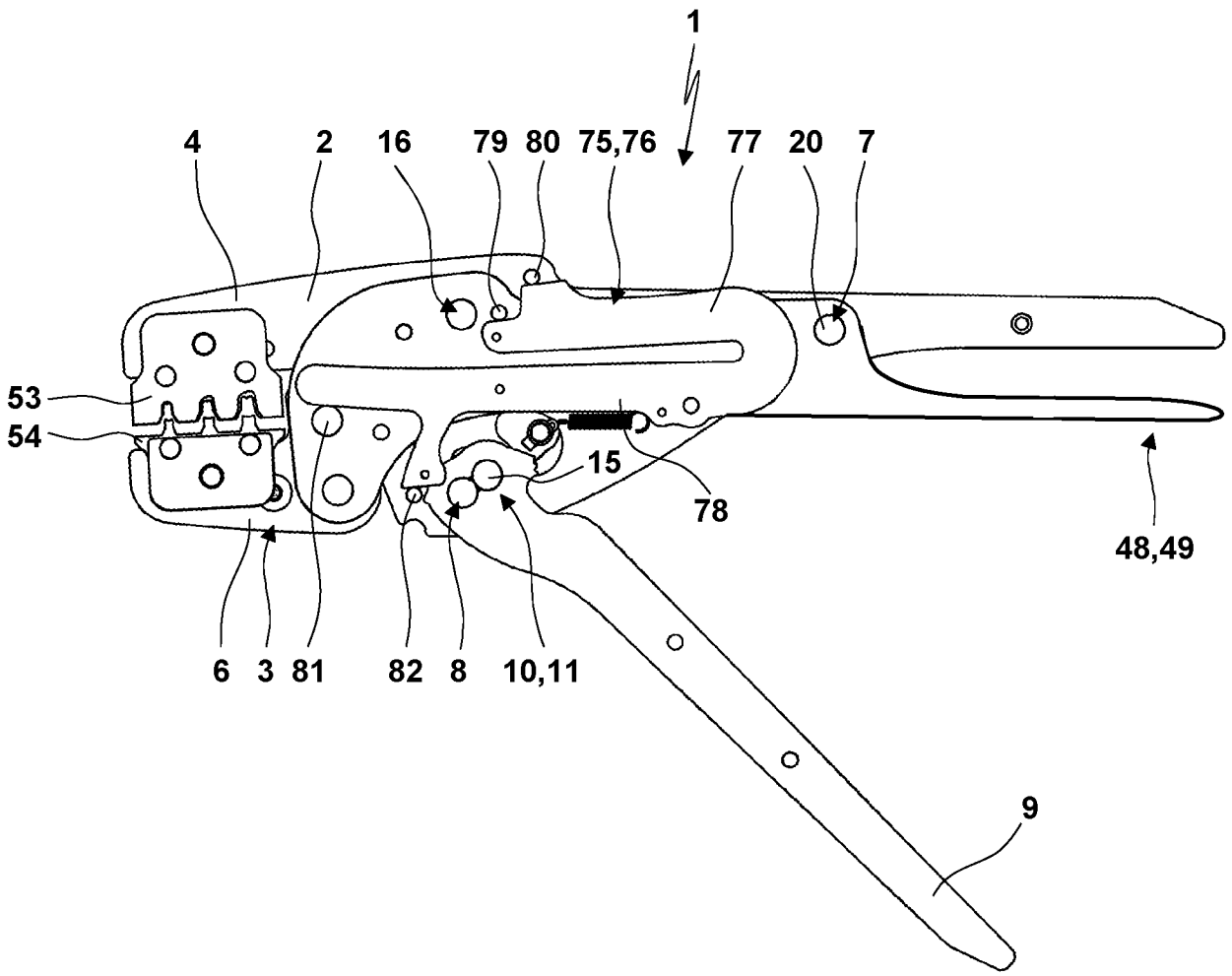

FIGS. 11 and 12 show an embodiment of crimping pliers 1 which substantially corresponds to the embodiment of the crimping pliers 1 according to FIGS. 1 to 9 apart from the differences mentioned in the following. However, the pressure lever 12 does not comprise an elongated hole 51, so that the drive mechanism 10 does not comprise play 50. This results in the movable hand lever 9 being pivoted (further) in the opening direction when the additional hand lever 49 is actuated in order to transfer the movable pliers jaw 6 into the insertion and/or removal position 56.

Differently from FIGS. 1 and 9, for the embodiment shown in FIGS. 11 and 12, the closing spring 36 and the opening spring 42 are realized differently and integrated into the crimping pliers 1: The closing spring 36 and the opening spring 42 here are realized as an integral spring device 75, which is a U-shaped flexible spring 76 (to be deflected by bending) comprising two elastic side arms 77, 78 connected to each other. The side arm 77 in its free end portion is supported on a support 79 realized or held by the movable pliers part 3. In this end portion, the side arm 77 additionally is also supported on a support 80 realized or supported by the fixed pliers part 2. The other side arm 78 in an end portion is supported against a support 81 formed or held by the movable pliers part 3. Furthermore, the side arm 78 is supported against a support 82 formed or supported by the fixed pliers part 2. For this embodiment, a change in the functioning of the crimping pliers 1 results as follows:

In FIG. 12, the spring device 75 is supported on the fixed pliers part 2 between the two supports 80, 82 and therefore caught between them. Therefore, this is a stable equilibrium position. Actuating the additional hand lever 49 leads to the support 79 taking along the side arm 77 while the side arm 78 is still supported on the support 82. The spring device 75 therefore is compressed and creates a closing spring force. During this motion caused by the additional hand lever 49, the side arm 77 detaches from the support 80 and the side arm 78 detaches from the support 81. In the insertion and/or removal position initiated via the additional hand lever 49, therefore a closing spring force created by the spring device 75 is present, which strives to move the movable pliers jaw 6 back into the starting position according to FIG. 12. Therefore, a workpiece 57 is clamped here as well, as long as the dimensions of the workpiece 57 are large enough that clamping is achieved in a position of the movable pliers jaw 6 which is opened further than in the starting position according to FIG. 12.

If by means of the movable hand lever 9 the pressing stroke or crimping stroke as such is executed, the support 61 moves the side arm 78 along so that the side arm 78 detaches from the support 82. On the contrary, during the crimping stroke or pressing stroke the side arm 77 is supported on the support 80 while the support 79 moves away from the side arm 77. The spring device 75 therefore during the pressing stroke or crimping stroke produces an opening spring force which when the closed position is reached can be used for an automatic opening motion into the starting position according to FIG. 12 caused by the spring device 75.

Figure 13:
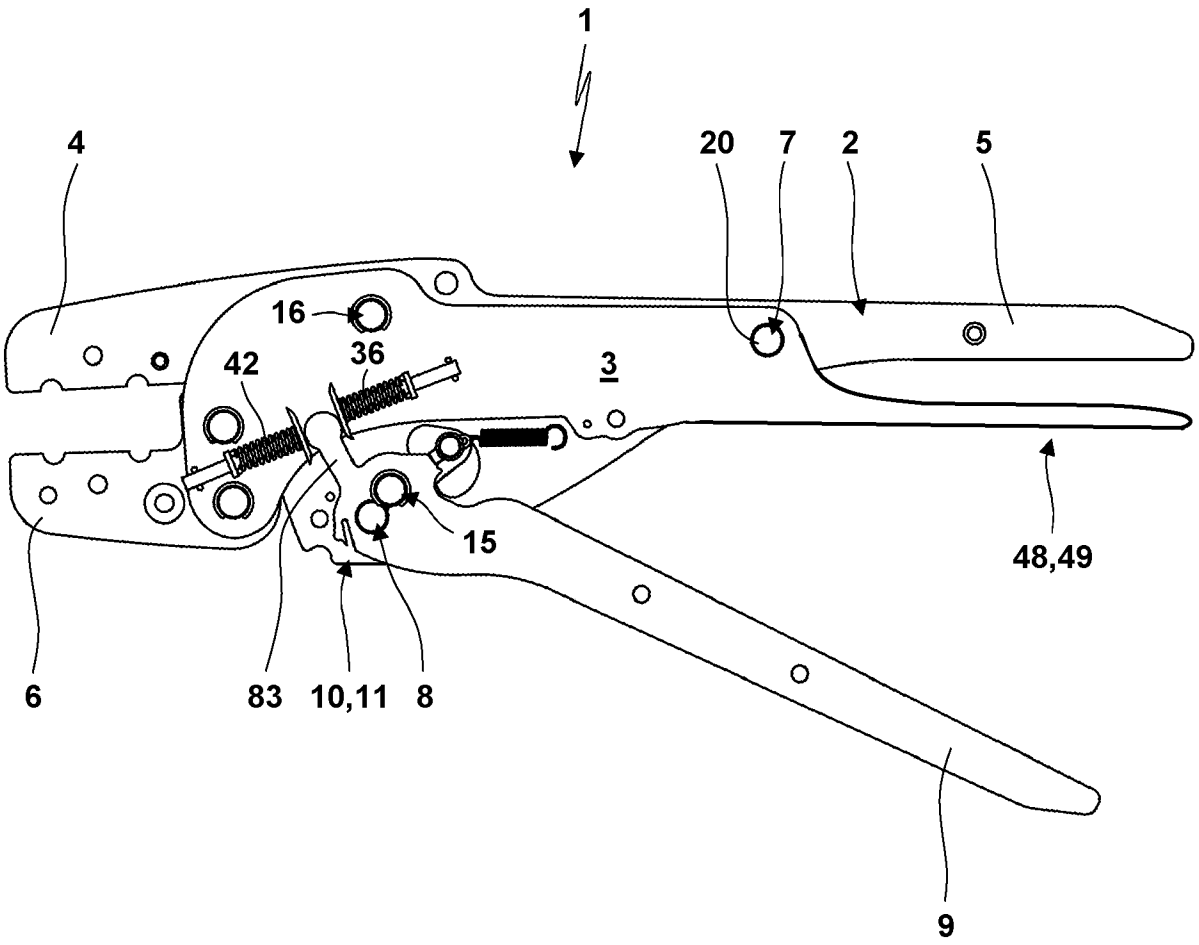

FIG. 13 also shows an embodiment of the crimping pliers 1 in which the drive mechanism 10 does not comprise play 50. Generally, the actuation kinematics of the crimping pliers 1 according to FIG. 13 are realized according to the previously described embodiments. In this case, however, the movable hand lever 9 comprises a hand lever part 83 which for a motion from the starting position into the insertion and/or removal position biases a closing spring 36 while the hand lever part 83 biases an opening spring 42 in order to execute the pressing stroke or crimping stroke from the starting position into the closed position. The opening spring 42 and the closing spring 36 may follow the lever part 83 on different sides only up to the starting position by means of suitable stops.

Figure 14:
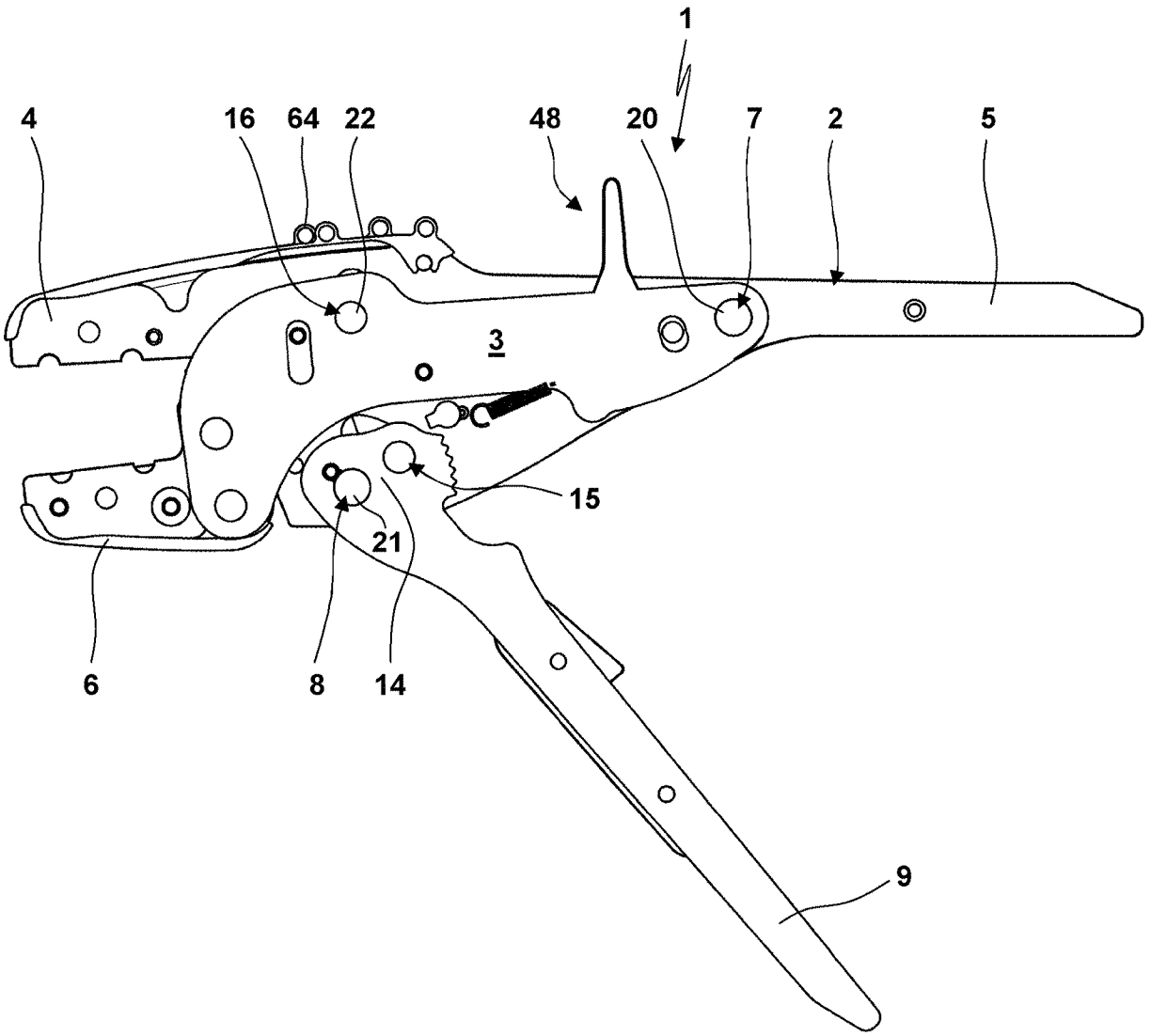

The embodiment of the crimping pliers 1 shown in FIG. 14 generally corresponds to the embodiment shown in FIGS. 1 to 9. However, the further lever 48 in this case is not realized as an additional hand lever 49 arranged between the two hand levers 5, 9. Rather than that, for this embodiment the further lever 48 extends outside of the interspace between the two hand levers 5, 8. For the embodiment shown, the further lever 48 extends out of the housing of the crimping pliers 1 formed with the fixed pliers part plates 17. It is possible for the further lever 48 to be arranged and designed in such a way in this case that when a hand of a user is applied onto the fixed hand lever 5 actuating the further lever 48 by a finger, especially by a thumb of the hand, is possible.

For the embodiment shown in FIGS. 1 to 9, in a storage position the movable hand lever 9 is in its open position. In order to store the crimping pliers, this embodiment needs comparatively much space. If this is to be avoided, while apart from this the crimping pliers 1 are designed in the same way, the movable hand lever 9 can be locked or latched in the closed position (or in another position). It can then be made to leave the locking position by the user applying sufficient actuation forces onto the movable hand lever 9. Alternatively, by unlocking a locking mechanism due to the effect of the opening spring the movable hand lever 9 can be automatically transferred into the open position.

Many variations and modifications may be made to the preferred embodiments of the invention without departing substantially from the spirit and principles of the invention. All such modifications and variations are intended to be included herein within the scope of the present invention, as defined by the following claims.

We claim:

1. Pressing tongs or crimping pliers for crimping or pressing a workpiece comprising:

a) a fixed pliers part with a fixed hand lever and a fixed pliers jaw,
b) a movable hand lever,
c) a movable pliers jaw,
d) a further lever,
e) a drive mechanism,
f) a drive connection and
g) an insertion and extraction position, where
h) the movable hand lever can undergo a pivoting motion towards the fixed hand lever,
i) the further lever can undergo a pivoting motion and
j) the movable pliers jaw can undergo a closing motion and an opening motion,
k) the movable hand lever is coupled to the movable pliers jaw via the drive mechanism and the drive mechanism is configured to convert the pivoting motion of the movable hand lever towards the fixed hand lever into the closing motion of the movable pliers jaw, where when the closing motion of the movable pliers jaw is executed, the workpiece can be crimped or pressed,
l) the further lever is coupled to the movable pliers jaw by the drive connection and the drive connection is configured to convert the pivoting motion of the further lever into the opening motion of the pliers jaw, where the opening motion of the pliers jaw brings the pressing tongs or crimping pliers into the insertion and extraction position, and
m) wherein the further lever is an additional hand lever pivotally coupled to the fixed hand lever and positioned between an inner edge of the fixed hand lever and an inner edge of the movable hand lever.

2. Pressing tongs or crimping pliers according to claim 1, wherein the further lever is coupled to the movable pliers jaw via the drive connection in such a way that when the further lever is pivoted towards the fixed hand lever, the opening motion of the movable pliers jaws can be initiated.

3. Pressing tongs or crimping pliers according to claim 1, wherein the drive connection is a rigid connection of the further lever to the movable pliers jaw.

4. Pressing tongs or crimping pliers according to claim 1, wherein a) the pressing tongs or crimping pliers comprise an opening spring,
b) the movable pliers jaw and the movable hand lever comprise a closed position and
c) the opening spring biases the movable pliers jaw and the movable hand lever in an opening direction such that the movable pliers jaw and the movable hand lever are automatically moved from the closed position in the opening direction.

5. Pressing tongs or crimping pliers according to claim 1, wherein a) the pressing tongs or crimping pliers comprise a closing spring, b) the further lever comprises a closed position and an open position and c) the closing spring biases the movable pliers jaw and the further lever in a closing direction from the closed position towards the open position.

6. Pressing tongs or crimping pliers according to claim 1, wherein a) the pressing tongs or crimping pliers comprise a movable pliers part, a closing spring and an opening spring and b) the further lever comprises a closed position and an open position and c) the closing spring comprises a first closing spring base and a second closing spring base and d) the opening spring comprises a first opening spring base and a second opening spring base, where e) the movable pliers part transmits the motion of the further lever to the motion of the movable pliers jaw and f) the first closing spring base of the closing spring is linked to the fixed pliers part and the second closing spring base of the closing spring is linked to the movable pliers part such that the closing spring biases the movable pliers jaw and the further lever in closing direction such that the further lever automatically moves in closing direction from its closed position towards its open position and g) the first opening spring base of the opening spring is linked to the fixed pliers part and the second opening spring base of the opening spring is linked to the movable hand lever such that the opening spring biases the movable pliers jaw and the movable hand lever in opening direction such that the movable pliers jaw and the movable hand lever are automatically moved from the closed position in opening direction.

7. Pressing tongs or crimping pliers according to claim 1, wherein a) the pressing tongs or crimping pliers further comprise a closed position and, b) the drive mechanism comprises a drive element, a stop and a play, where c) a pressing or crimping force can be transmitted via the drive mechanism, d) the stop limits the play, e) while the movable hand lever is being pivoted towards the fixed hand lever and the movable pliers jaw undergoes the closing motion into the closed position, the drive element rests against the stop in order to transmit the pressing or crimping force and f) while the further lever is being pivoted and the movable pliers jaw undergoes the opening motion into the insertion and extraction position, the drive element moves away from the stop, taking advantage of the play.

8. Pressing tongs or crimping pliers according to claim 1, wherein a) the movable pliers jaw comprises a closed position and an open position, b) the movable hand lever comprises an open position and c) the drive mechanism comprises a play, where d) the play is at least large enough such that in the open position of the movable hand lever it is possible that the movable pliers jaw is moved from its closed position into its open position, dependently on the position of the further lever, without the movable hand lever leaving its open position.

9. Pressing tongs or crimping pliers according to claim 1, wherein a) the pressing tongs or crimping pliers comprise a closing spring and an opening spring, b) the movable hand lever comprises an open position and c) the further lever comprises a closed position and an open position, where d) an opening spring force can be exerted by the opening spring, e) a closing spring force can be exerted by the closing spring and f) in the open position of the movable hand lever fa) the opening spring exerts no opening spring force onto the movable pliers jaw and fb) the closing spring exerts the closing spring force onto the movable pliers jaw, where the closing spring force exerts a minimum force in the closed position of the further lever and exerts a maximum force in the open position of the further lever.

10. Pressing tongs or crimping pliers according to claim 8, wherein the drive mechanism comprises an elongated hole, where the elongated hole provides the play and the stop is formed by an end portion of the elongated hole.

11. Pressing tongs or crimping pliers according to claim 1, wherein the pressing tongs or crimping pliers comprise a toggle lever drive and the toggle lever drive forms the drive mechanism.

12. Pressing tongs or crimping pliers according to claim 11, wherein the pressing tongs or crimping pliers comprise a toggle lever drive and the toggle lever drive forms the drive mechanism.

13. Pressing tongs or crimping pliers according to claim 12, wherein a) the toggle lever drive comprises a pivot bolt and b) the pivot bolt is accommodated in the elongated hole.

14. Pressing tongs or crimping pliers according to claim 1, wherein the pressing tongs or crimping pliers comprise a forced locking mechanism, a) caused by an opening pivoting movement of the further lever, the movable pliers jaw may undergo a first opening motion and b) caused by an opening pivoting movement of the movable hand lever, the movable pliers jaw may undergo a second opening motion, where the forced locking mechanism c) does not lock against the first opening motion of the movable pliers jaw caused by the further lever and d) locks against the second opening motion of the movable pliers jaws caused by the movable hand lever.

15. Pressing tongs or crimping pliers for crimping or pressing a workpiece comprising:

a) a fixed pliers part with a fixed hand lever and a fixed pliers jaw, b) a movable hand lever, c) a movable pliers jaw, d) a further lever, e) a drive mechanism, f) a drive connection and g) an insertion and extraction position, wherein h) the movable hand lever can undergo a pivoting motion towards the fixed hand lever, i) the further lever can undergo a pivoting motion and j) the movable pliers jaw can undergo a closing motion and an opening motion, k) the movable hand lever is coupled to the movable pliers jaw via the drive mechanism and the drive mechanism is configured to convert the pivoting motion of the movable hand lever towards the fixed hand lever into the closing motion of the movable pliers jaw, where when the closing motion of the movable pliers jaw is executed, the workpiece can be crimped or pressed, l) the further lever is coupled to the movable pliers jaw by the drive connection and the drive connection is configured to convert the pivoting motion of the further lever into the opening motion of the pliers jaw, where the opening motion of the pliers jaw brings the pressing tongs or crimping pliers into the insertion and extraction position, m) the further lever is pivotally coupled to the fixed hand lever and extends outside an interspace between the fixed hand lever and the movable hand lever and out of the housing of the crimping pliers formed with fixed pliers part plates, the further lever being configured such that when a hand of the user is applied onto the fixed hand lever the user is able to actuate the further lever by a finger of the hand.

16. Pressing tongs or crimping pliers for crimping or pressing a workpiece comprising:

a) a fixed pliers part with a fixed hand lever and a fixed pliers jaw, b) a movable hand lever, c) a movable pliers jaw, d) a further lever, e) a drive mechanism, f) a drive connection and g) an insertion and extraction position, wherein h) the movable hand lever can undergo a pivoting motion towards the fixed hand lever, i) the further lever can undergo a pivoting motion and j) the movable pliers jaw can undergo a closing motion and an opening motion, k) the movable hand lever is coupled to the movable pliers jaw via the drive mechanism and the drive mechanism is configured to convert the pivoting motion of the movable hand lever towards the fixed hand lever into the closing motion of the movable pliers jaw, where when the closing motion of the movable pliers jaw is executed, the workpiece can be crimped or pressed, l) the further lever is coupled to the movable pliers jaw by the drive connection and the drive connection is configured to convert the pivoting motion of the further lever into the opening motion of the pliers jaw, where the opening motion of the pliers jaw brings the pressing tongs or crimping pliers into the insertion and extraction position, m) an elongate hole is defined in the fixed pliers part, the drive mechanism comprising a pivot bolt forming a toggle joint, and the pivot bolt being accommodated in the elongated hole, n) wherein the further lever is pivotally coupled to the fixed hand lever.

17. Pressing tongs or crimping pliers according to claim 16, wherein the further lever is an additional hand lever positioned between an inner edge of the fixed hand lever and an inner edge of the movable hand lever.

18. Pressing tongs or crimping pliers according to claim 16, wherein the further lever extends outside of an interspace between the fixed hand lever and the movable hand lever and out of a housing of the crimping pliers formed with fixed pliers part plates, the further lever being configured such that when a hand of the user is applied onto the fixed hand lever the user is able to actuate the further lever by a finger of the hand.

* * * * *